US006516293B1

(12) United States Patent
Huang et al.

(10) Patent No.: US 6,516,293 B1
(45) Date of Patent: Feb. 4, 2003

(54) METHOD FOR SIMULATING DRILLING OF ROLLER CONE BITS AND ITS APPLICATION TO ROLLER CONE BIT DESIGN AND PERFORMANCE

(75) Inventors: Sujian Huang, The Woodlands, TX (US); Chris E. Cawthorne, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/524,088

(22) Filed: Mar. 13, 2000

(51) Int. Cl.[7] ..... G06F 9/455; G06F 19/00; E21B 10/16

(52) U.S. Cl. ..... 703/10; 703/7; 702/9; 345/711; 340/853.6; 175/331

(58) Field of Search ..... 703/7, 10; 702/6, 702/9, 11; 382/109; 345/711; 340/853.1, 853.3, 853.6; 175/331, 339, 377, 57; 73/152.02, 152.47

(56) References Cited

U.S. PATENT DOCUMENTS

| | | | | |
|---|---|---|---|---|
| 4,408,671 A | * | 10/1983 | Munson | 175/377 |
| 4,815,342 A | | 3/1989 | Brett et al. | 76/108 A |
| 5,787,022 A | | 7/1998 | Tibbitts et al. | 364/578 |
| 5,864,058 A | * | 1/1999 | Chen | 73/152.47 |
| 5,868,213 A | * | 2/1999 | Cisneros et al. | 175/331 |
| 5,950,747 A | | 9/1999 | Tibbitts et al. | 175/432 |
| 6,021,377 A | | 2/2000 | Dubinsky et al. | 702/9 |
| 6,095,262 A | * | 8/2000 | Chen | 175/57 |
| 6,213,225 B1 | | 4/2001 | Chen | 175/57 |
| 6,241,034 B1 | * | 6/2001 | Steinke et al. | 175/331 |
| 6,290,006 B1 | * | 9/2001 | Crawford | 175/339 |
| 6,349,595 B1 | * | 2/2002 | Civolani et al. | 73/152.02 |
| 6,401,839 B1 | | 6/2002 | Chen | 175/57 |
| 6,412,577 B1 | | 7/2002 | Chen | 175/57 |

FOREIGN PATENT DOCUMENTS

| | | |
|---|---|---|
| WO | WO 00/12859 | 3/2000 |
| WO | WO 00/12860 | 3/2000 |

OTHER PUBLICATIONS

Hancke et al., G.P. A Control System for Optimizing Deep Hole Drilling Conditions, IECON 1991 International Conference on Industrial Electronics, Control and Instrumentation, 1991, pp. 2279–2284.*

Ertunc et al., H.M. Real Time Monitoring of Tool Wear Using Multiple Modeling Method, IEEE International Electric Machines and Drives Conference, IEMDC 2001, pp. 687–691.*

(List continued on next page.)

*Primary Examiner*—Russell Frejd
(74) *Attorney, Agent, or Firm*—Rosenthal & Osha L.L.P.

(57) ABSTRACT

A method for simulating the drilling performance of a roller cone bit drilling an earth formation may be used to generate a visual representation of drilling, to design roller cone drill bits, and to optimize the drilling performance of a roller cone bit. The method for generating a visual representation of a roller cone bit drilling earth formations includes selecting bit design parameters, selecting drilling parameters, and selecting an earth formation to be drilled. The method further includes calculating, from the bit design parameters, drilling parameters and earth formation, parameters of a crater formed when one of a plurality of cutting elements contacts the earth formation. The method further includes calculating a bottomhole geometry, wherein the crater is removed from a bottomhole surface. The method also includes incrementally rotating the bit and repeating the calculating of crater parameters and bottomhole geometry based on calculated roller cone rotation speed and geometrical location with respect to rotation of said roller cone drill bit about its axis. The method also includes converting the crater and bottomhole geometry parameters into a visual representation.

64 Claims, 17 Drawing Sheets

OTHER PUBLICATIONS

Hancke, G.P. The Effective Control of a Deep Hole Diamond Drill, Conference Record of the IEEE Industry Applications Society Annual Meeting, 1991, pp. 1200–1205.*
Howie et al., W.L. A Smart Bolter for Improving Entry Stability, Conference Record of the IEEE Industry Applications Society Annual Meeting, 1989, pp. 1556–1564.*
Dekun Ma et al.; "The Computer Simulation of the Interaction Between Roller Bit and Rock"; International Meeting on Petroleum Engineering; PR China; Nov. 14–17, 1995; pp. 309–317.
Ma Dekun et al., "The Operational Mechanics of The Rock Bit", Petroleum Industry Press, 1996, pp. 1–243.
Society of Petroleum Engineers Paper No. 56439, "Field Investigation of the Effects of Stick–Slip, Lateral, and Whirl Vibrations on Roller Cone Bit Performance", S. L. Chen et al., presented Oct. 3–6, 1999, 10 pages.
Society of Petroleum Engineers Paper No. 71053, "Development and Application of a New Roller Cone Bit with Optimized Tooth Orientation", S. L. Chen et al., presented May 21–23, 2001, 15 pages.
Society of Petroleum Engineers Paper No. 71393, "Development and Field Applications of Roller Cone Bits with Balanced Cutting Structure", S. L. Chen et al., presented Sep. 30 –Oct. 3, 2001, 11 pages.

* cited by examiner

BOH COVERAGE

HISTORY PLOT FOR CONE FORCE

FORCE ON EACH ROW: fz/w

FORCE ON EACH CONE: fz/w

FORCE DISTRIBUTION

FORCE (klbf) 1C-3R
BOX & WISKERS PLOT FOR ROW FORCE

METHOD FOR SIMULATING DRILLING OF ROLLER CONE BITS AND ITS APPLICATION TO ROLLER CONE BIT DESIGN AND PERFORMANCE

BACKGROUND OF THE INVENTION

1. Technical Field

The invention relates generally to roller cone drill bits, and more specifically to simulating the drilling performance of roller cone bits. In particular, the invention relates to methods for generating a visual representation of a roller cone bit drilling earth formations, methods for designing roller cone bits, and methods for optimizing the drilling performance of a roller cone bit design.

2. Background Art

Roller cone rock bits and fixed cutter bits are commonly used in the oil and gas industry for drilling wells. FIG. 1 shows one example of a conventional drilling system drilling an earth formation. The drilling system includes a drilling rig 10 used to turn a drill string 12 which extends downward into a well bore 14. Connected to the end of the drill string 12 is roller cone-type drill bit 20, shown in further detail in FIG. 2. Roller cone bits 20 typically comprise a bit body 22 having an externally threaded connection at one end 24, and a plurality of roller cones 26 (usually three as shown) attached to the other end of the bit and able to rotate with respect to the bit body 22. Attached to the cones 26 of the bit 20 are a plurality of cutting elements 28 typically arranged in rows about the surface of the cones 26. The cutting elements 28 can be tungsten carbide inserts, polycrystalline diamond compacts, or milled steel teeth.

Significant expense is involved in the design and manufacture of drill bits. Therefore, having accurate models for simulating and analyzing the drilling characteristics of bits can greatly reduce the cost associated with manufacturing drill bits for testing and analysis purposes. For this reason, several models have been developed and employed for the analysis and design of fixed cutter bits. These fixed cutter simulation models have been particularly useful in that they have provided a means for analyzing the forces acting on the individual cutting elements on the bit, thereby leading to the design of, for example, force-balanced fixed cutter bits and designs having optimal spacing and placing of cutting elements on such bits. By analyzing forces on the individual cutting elements of a bit prior to making the bit, it is possible to avoid expensive trial and error designing of bit configurations that are effective and long lasting.

However, roller cone bits are more complex than fixed cutter bits in that cutting surfaces of the bit are disposed on the roller cones, wherein each roller cone independently rotates relative to the rotation of the bit body about axes oblique to the axis of the bit body. Additionally, the cutting elements of the roller cone bit deform the earth formation by a combination of compressive fracturing and shearing, whereas fixed cutter bits typically deform the earth formation substantially entirely by shearing. Therefore, accurately modeling the drilling performance of roller cone bits requires more complex models than for fixed cutter bits. Currently, no reliable roller cone bit models have been developed which take into consideration the location, orientation, size, height, and shape of each cutting element on the roller cone, and the interaction of each individual cutting element on the cones with earth formations during drilling.

Some researchers have developed a method for modeling roller cone cutter interaction with earth formations. See D. Ma et al, The Computer Simulation of the Interaction Between Roller Bit and Rock, paper no. 29922, Society of Petroleum Engineers, Richardson, Tex. (1995). However, such modeling has not yet been used in the roller cone bit design process to simulate the overall drilling performance of a roller cone bit, taking into consideration the equilibrium condition of forces and the collective drilling contribution of each individual cutting element drilling earth formations. The drilling contribution can be defined as the forming of craters due to pure cutting element interference and the brittle fracture of the formation.

There is a great need to simulate and optimize performance of roller cone bits drilling earth formations. Simulation of roller cone bits would enable analyzing the drilling characteristics of proposed bit designs and permit studying the effect of bit design parameter changes on the drilling characteristics of a bit. Such analysis and study would enable the optimization of roller cone drill bit designs to produce bits which exhibit desirable drilling characteristics and longevity. Similarly, the ability to simulate roller cone bit performance would enable studying the effects of altering the drilling parameters on the drilling performance of a given bit design. Such analysis would enable the optimization of drilling parameters for purposes of maximizing the drilling performance of a given bit.

SUMMARY OF THE INVENTION

In general, the invention comprises a method for simulating a roller cone bit drilling earth formations, which can be visually displayed and, alternatively, used to design roller cone drill bits or optimize drilling parameters for a selected roller cone bit drilling an earth formation.

In one aspect, the invention provides a method for generating a visual representation of a roller cone bit drilling earth formations. The method includes selecting bit design parameters, selecting drilling parameters, and selecting an earth formation to be drilled. The method further includes calculating, from the bit design parameters, drilling parameters and earth formation, parameters of a crater formed when one of a plurality of cutting elements contacts the earth formation. The method further includes calculating a bottomhole geometry, wherein the crater is removed from a bottomhole surface. The method also includes incrementally rotating the bit and repeating the calculating of crater parameters and bottomhole geometry based on calculated roller cone rotation speed and geometrical location with respect to rotation of said roller cone drill bit about its axis. The method also includes converting the crater and bottomhole geometry parameters into a visual representation.

In another aspect aspect, the invention provides a method for designing a roller cone drill bit. The method includes selecting initial bit design parameters, selecting drilling parameters, and selecting an earth formation to be drilled. The method further includes calculating, from the bit design parameters, drilling parameters and earth formation, parameters of a crater formed when one of a plurality of cutting elements contacts the earth formation. The method further includes calculating a bottomhole geometry, wherein the crater is removed from a bottomhole surface. The method also includes incrementally rotating the bit and repeating the calculating of crater parameters and bottomhole geometry based on calculated roller cone rotation speed and geometrical location with respect to rotation of said roller cone drill bit about its axis. The method further includes adjusting at least one of the bit design parameters and repeating the calculating until an optimal set of bit design parameters is obtained. Bit design parameters that can be optimized include, but are not limited to, cutting element count, cutting element height, cutting element geometrical shape, cutting element spacing, cutting element location, cutting element orientation, cone axis offset, cone diameter profile, and bit diameter.

In another aspect, the invention provides a method for optimizing drilling parameters for a roller cone drill bit. The method includes selecting bit design parameters, selecting initial drilling parameters, and selecting an earth formation to be drilled. The method further includes calculating, from the bit design parameters, drilling parameters and earth formation, parameters of a crater formed when one of a plurality of cutting elements contacts the earth formation. The method further includes calculating a bottomhole geometry, wherein the crater is removed from a bottomhole surface. The method also includes incrementally rotating the bit and repeating the calculating of crater parameters and bottomhole geometry based on calculated roller cone rotation speed and geometrical location with respect to rotation of said roller cone drill bit about its axis. Additionally, the method includes adjusting at least one of the drilling parameters and repeating the calculating until an optimal set of drilling parameters is obtained. The drilling parameters which can be optimized using the invention include, but are not limited to weight on bit and rotational speed of bit.

DESCRIPTION OF PREFERRED EMBODIMENTS

Figure 1:
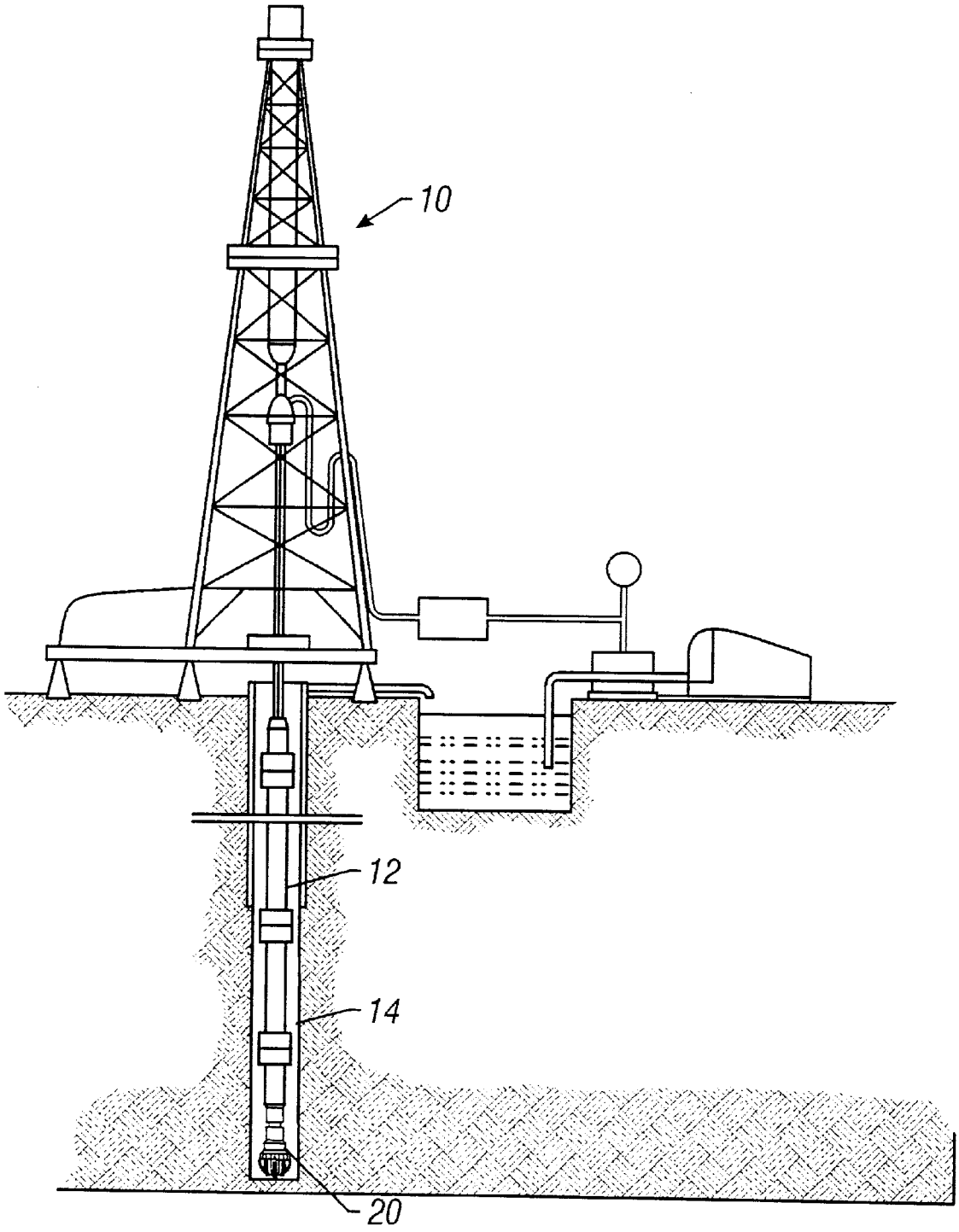
FIG.1 (Prior Art)
FIG. 1 shows a schematic diagram of a drilling system for drilling earth formations having a drill string attached at one end to a roller cone drill bit.
Figure 2:
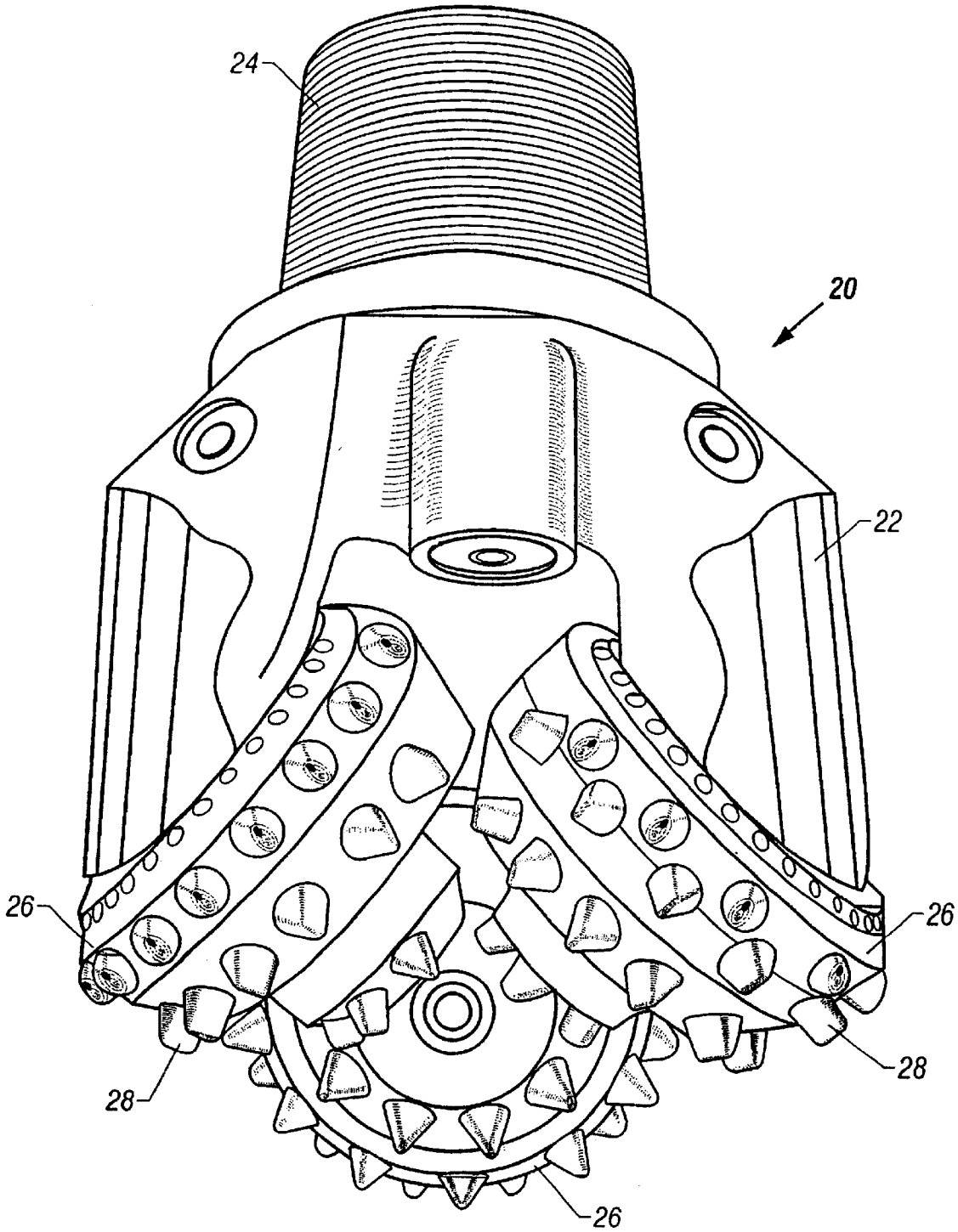
FIG.2 (Prior Art)
FIG. 2 shows a perspective view of a roller cone drill bit.
Figure 3A:
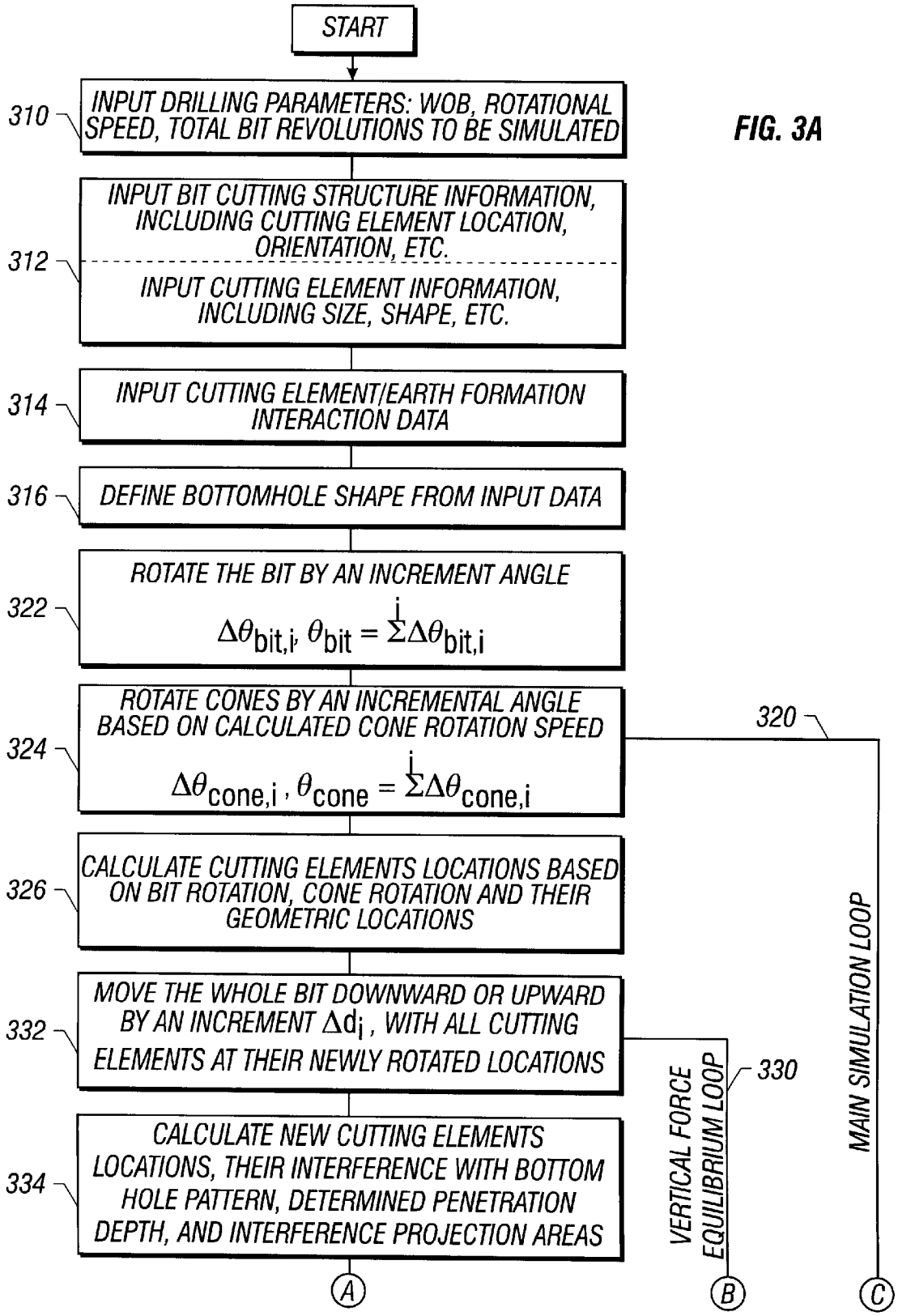
FIGS. 3A and FIG. 3B show a flowchart of an embodiment of the invention for generating a visual representation of a roller cone bit drilling earth formations.
Figure 3B:
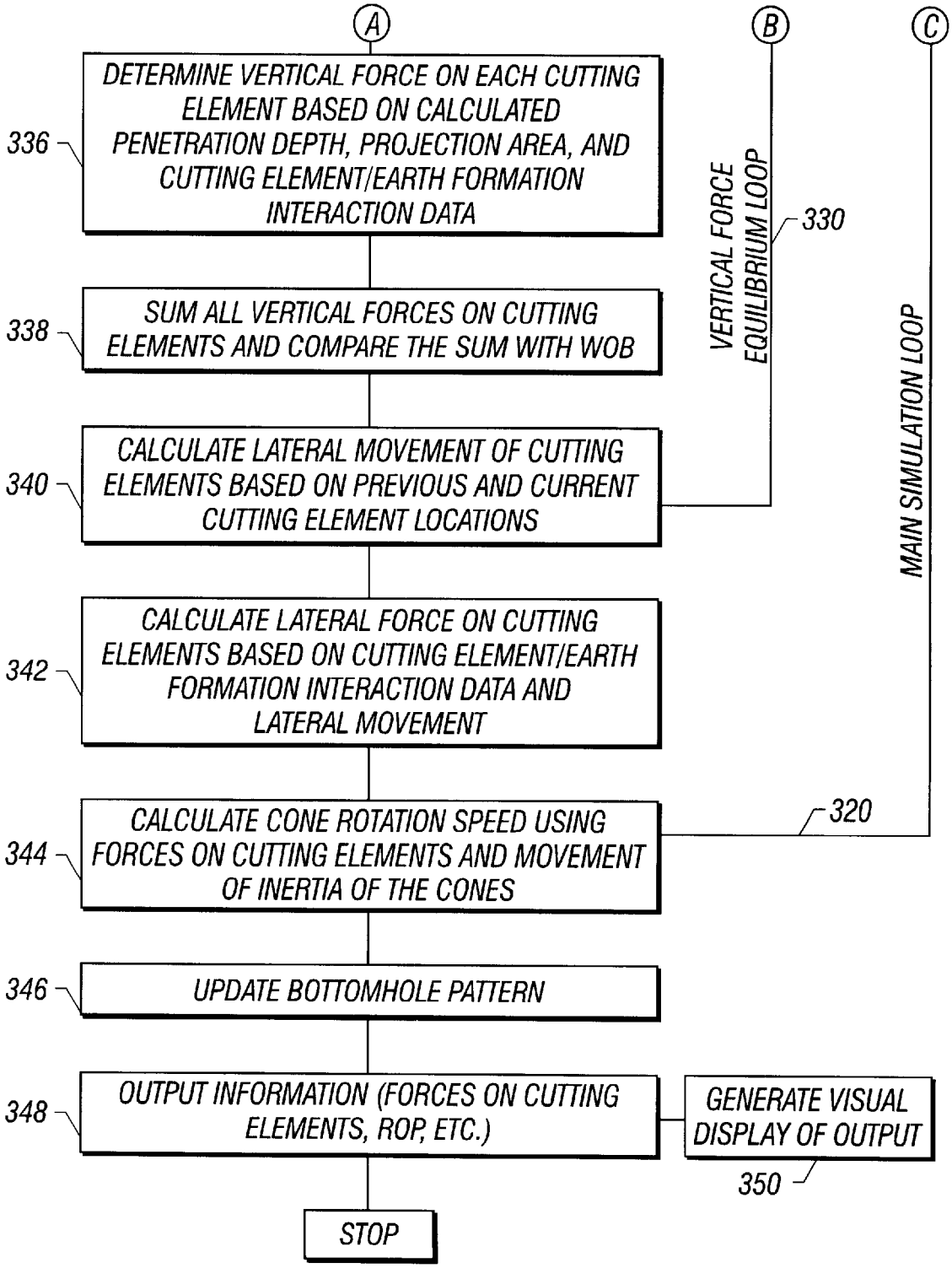

FIG. 3A and 3B show a flow chart of one embodiment of the invention for generating a visual representation of a roller cone drill bit drilling earth formations. The parameters required as input for the simulation include drilling parameters 310, bit design parameters 312, cutting element/earth formation interaction data 314, and bottomhole geometry data 316. Typically the bottomhole geometry prior to any drilling simulation will be a planar surface, but this is not a limitation on the invention. The input data 310, 312, 314, 316 may be stored in an input library and later retrieved as need during simulation calculations.

Drilling parameters 310 which may be used include the axial force applied on the drill bit, commonly referred to as the weight on bit (WOB), and the rotation speed of the drill bit, typically provided in revolutions per minute (RPM). It must be understood that drilling parameters are not limited to these variables, but may include other variables, such as, for example, rotary torque and mud flow volume. Additionally, drilling parameters 310 provided as input may include the total number of bit revolutions to be simulated, as shown in FIG. 3A. However, it should be understood that the total number of revolutions is provided simply as an end condition to signal the stopping point of simulation, and is not necessary for the calculations required to simulate or visually represent drilling. Alternatively, another end condition may be employed to determine the termination point of simulation, such as the total drilling depth (axial span) to be simulated or any other final simulation condition. Alternatively, the termination of simulation may be accomplished by operator command, or by performing any other specified operation.

Bit design parameters 312 used as input include bit cutting structure information, such as the cutting element location and orientation on the roller cones, and cutting element information, such as cutting element size(s) and shape(s). Bit design parameters 312 may also include bit diameter, cone diameter profile, cone axis offset (from perpendicular with the bit axis of rotation), cutting element count, cutting element height, and cutting element spacing between individual cutting elements. The cutting element and roller cone geometry can be converted to coordinates and used as input for the invention. Preferred methods for bit design parameter inputs include the use of 3-dimensional CAD solid or surface models to facilitate geometric input.

Cutting element/earth formation interaction data 314 used as input includes data which characterize the interaction between a selected earth formation (which may have, but need not necessarily have, known mechanical properties) and an individual cutting element having known geometry. Preferably, the cutting element/earth formation interaction data 314 takes into account the relationship between cutting element depth of contact into the formation (interference depth) and resulting earth formation deformation. The deformation includes plastic deformation and brittle failure (fracture). Interaction data 314 can be obtained through experimental testing and/or numerical modeling as will be further explained with reference to FIGS. 8A–8C and FIG. 5.

Bottomhole geometry data 316 used as input includes geometrical information regarding the bottomhole surface of an earth formation, such as the bottomhole shape. As previously explained, the bottomhole geometry typically will be planar at the beginning of a simulation using the invention, but this is not a limitation on the invention. The bottomhole geometry can be represented as a set of axial (depth) coordinates positioned within a defined coordinate system, such as in a Cartesian coordinate system. In this embodiment, a visual representation of the bottomhole surface is generated using a coordinate mesh size of 1 millimeter, but the mesh size is not a limitation on the invention.

As shown in FIG. 3A, once the input data are entered or otherwise made available, calculations in the main simulation loop 320 can be carried out. To summarize the functions performed in the main simulation loop 320, drilling simulation is incrementally calculated by "rotating" the bit through an incremental angle, and then iteratively determining the vertical (axial) displacement of the bit corresponding to the incremental bit rotation. Once the vertical displacement is obtained, the lateral forces on the cutting elements are calculated and are used to determine the current rotation speed of the cones. Finally, the bottomhole geometry is updated by removing the deformed earth formation resulting from the incremental drilling calculated in the simulation loop 320. A more detailed description of the elements in the simulation loop 320 is as follows.

The first element in the simulation loop 320 in FIG. 3A, involves "rotating" the roller cone bit (numerically) by the selected incremental angle amount, $\Delta\theta_{bit,i}$, 322. In this example embodiment, the selected incremental angle is 3 degrees. It should be understood that the incremental angle is a matter of convenience for the system designer and is not intended to limit the invention. The incremental rotation of the bit results in an incremental rotation of each cone on the bit, $\Delta\theta_{cone,i}$. To determine the incremental rotation of the cones, $\Delta\theta_{cone,i}$, resulting from the incremental rotation of the bit, $\Delta\theta_{bit,i}$, requires knowledge of the rotational speed of the cones. In one example, the rotational speed of the cones is determined by the rotational speed of the bit and the effective radius of the "drive row" of the cone. The effective radius is generally related to the radial extent of the cutting elements that extend axially the farthest from the axis of rotation of the cone, these cutting elements generally being located on a so-called "drive row". Thus the rotational speed of the cones can be defined or calculated based on the known bit rotational speed of the bit and the defined geometry of the cone provided as input (e.g., the cone diameter profile, and cone axial offset). Then the incremental rotation of the cones, $\Delta\theta_{cone,i}$, is calculated based on incremental rotation of the bit, $\Delta\theta_{bit,i}$, and the calculated rotational speed of the cones 324. Alternatively, the incremental rotation of the cones can be calculated according to the frictional force between the cutting elements and the formation using a method as described, for example, in D. Ma et al, The Computer Simulation of the Interaction Between Roller Bit and Rock, paper no. 29922, Society of Petroleum Engineers, Richardson, Tex. (1995).

Once the incremental angle of each cone $\Delta\theta_{cone,i}$ is calculated, the new locations of the cutting elements, $p_{74,i}$ are computed based on bit rotation, cone rotation, and the immediately previous locations of the cutting elements $p_{i-l}$. The new locations of the cutting elements 326 can be determined by geometric calculations known in the art. Based on the new locations of the cutting elements, the vertical displacement of the bit resulting from the incremental rotation of the bit is, in this embodiment, iteratively computed in a vertical force equilibrium loop 330.

Figure 8A:
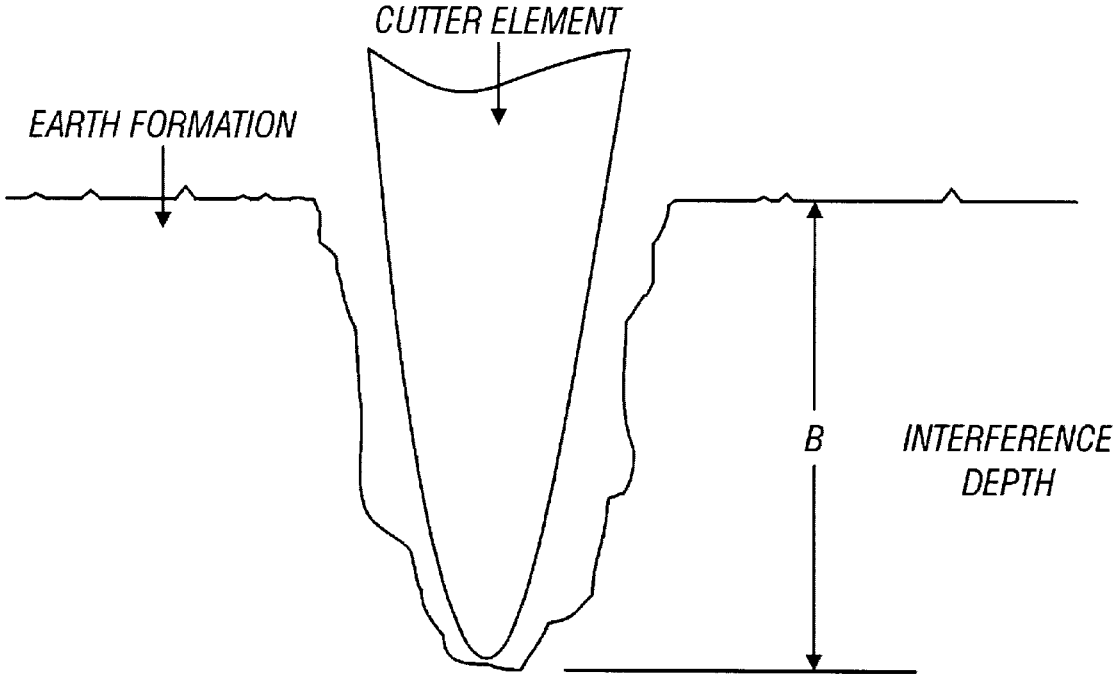
FIG. 8A shows one example of a cutting element of a roller cone bit penetrating an earth formation.
Figure 8B:
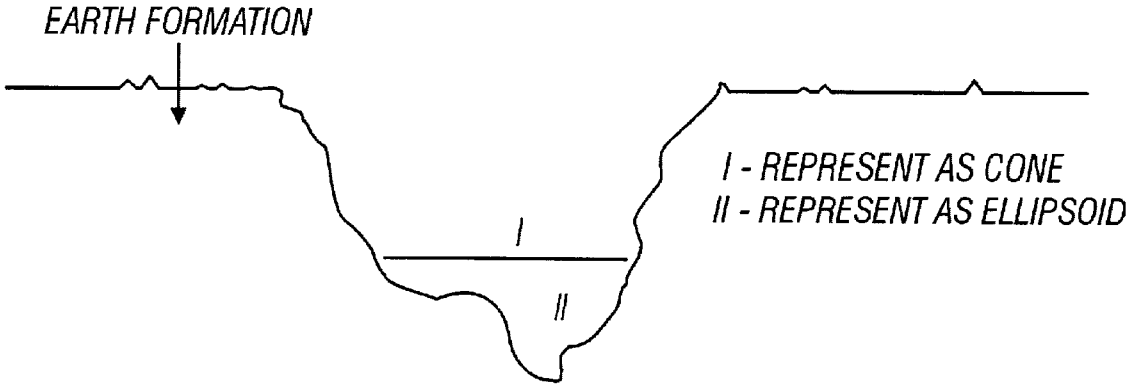
FIG. 8B shows one example of a crater formed from subsequent contacts of a cutting element in an earth formation.
Figure 8C:
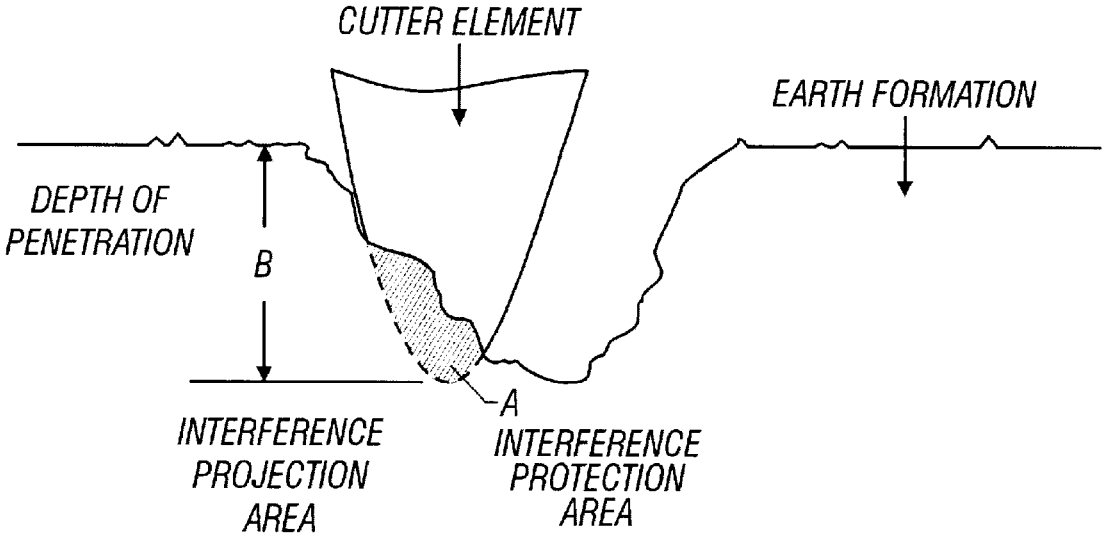
FIG. 8C shows one example of an interference projection area of a cutting element which is less than the full contact area corresponding to the depth of penetration of the cutting element penetrating earth formation with flat surface, due to intersection of the cutting element with a crater formed by previous contact of a cutting element with the earth formation.

In the vertical force equilibrium loop 330, the bit is "moved" (axially) downward (numerically) a selected initial incremental distance $\Delta d_i$ and new cutting element locations $p_i$ are calculated, as shown at 332 in FIG. 3A. In this example, the selected initial incremental distance is 2 mm. It should be understood that the initial incremental distance selected is a matter of convenience for the system designer and is not intended to limit the invention. Then the cutting element interference with the existing bottomhole geometry is determined, at 334. This includes determining the depth of penetration b of each cutting element into the earth formation, shown in FIG. 8A, and a corresponding interference projection area A, shown in FIG. 8C. The depth of penetration b is defined as the distance from the formation surface a cutting element penetrates into an earth formation, which can range from zero (no penetration) to the full height of the cutting element (full penetration). The interference projection area A is the fractional amount of surface area of the cutting element which actually contacts the earth formation. Upon first contact of a cutting element with the earth formation, such as when the formation presents a smooth, planar surface to the cutting element, the interference projection area is substantially equal to the total contact surface area corresponding to the depth of penetration of the cutting element into the formation. However, upon subsequent contact of cutting elements with the earth formation during simulated drilling, each cutting element may have subsequent contact over less than the total contact area, as shown, for example in FIG. 8C. This less than full area contact comes about as a result of the formation surface having "craters" (deformation pockets) made by previous contact with a cutting element, as shown in FIG. 8B. Fractional area contact on any of the cutting elements reduces the axial force on those cutting elements, which can be accounted for in the simulation calculations.

Once the cutting element/earth formation interaction is determined for each cutting element, the vertical force, $f_{V,i}$ applied to each cutting element is calculated based on the calculated penetration depth, the projection area, and the cutting element/earth formation interaction data 312. This is shown at 336 in FIG. 3B. Thus, the axial force acting on each cutting element is related to the cutting element penetration depth b and the cutting element interference projection area A. In this embodiment, a simplifying assumption used in the simulation is that the WOB is equal to the summation of vertical forces acting on each cutting element. Therefore the vertical forces, $f_{V,i}$, on the cutting elements are summed to obtain a total vertical force $F_{V,i}$ on the bit, which is then compared to the selected axial force applied to the bit (the WOB) for the simulation, as shown at 338. If the total vertical force $F_{V,i}$ is greater than the WOB, the initial incremental distance $\Delta d_i$ applied to the bit is larger than the incremental axial distance that would result from the selected WOB. If this is the case, the bit is moved up a fractional incremental distance (or, expressed alternatively, the incremental axial movement of the bit is reduced), and the calculations in the vertical force equilibrium loop 330 are repeated for the resulting incremental distance. If the total vertical force $F_{V,i}$ on the cutting elements, using the resulting incremental axial distance is then less than the WOB, the resulting incremental distance $\Delta d_i$ applied to the bit is smaller than the incremental axial distance that would result from the selected WOB. In this case, the bit is moved further down a second fractional incremental distance, and the calculations in the vertical force equilibrium loop 330 are repeated for the second resulting incremental distance. The vertical force equilibrium loop 330 calculations iteratively continue until an incremental axial displacement for the bit is obtained which results in a total vertical force on the cutting elements substantially equal to the selected WOB, within a selected error range.

Once the incremental displacement, $\Delta d_i$, of the bit is obtained, the lateral movement of the cutting elements is calculated based on the previous, $p_{i-1}$,, and current, $P_i$, cutting element locations, as shown at 340. Then the lateral force, $f_{L,i}$, acting on the cutting elements is calculated based on the lateral movement of the cutting elements and cutting element/earth formation interaction data, as shown at 342. Then the cone rotation speed is calculated based on the forces on the cutting elements and the moment of inertia of the cones, as shown at 344.

Finally, the bottomhole pattern is updated, at 346, by calculating the interference between the previous bottomhole pattern and the cutting elements during the current incremental drilling step, and based on cutting element/earth formation interaction, "removing" the formation resulting from the incremental rotation of the selected bit with the selected WOB. In this example, the interference can be represented by a coordinate mesh or grid having 1 mm grid blocks.

This incremental simulation loop 320 can then be repeated by applying a subsequent incremental rotation to the bit 322 and repeating the calculations in the incremental simulation loop 320 to obtain an updated bottomhole geometry. Using the total bit revolutions to be simulated as the termination command, for example, the incremental displacement of the bit and subsequent calculations of the simulation loop 320 will be repeated until the selected total number of bit revolutions to be simulated is reached. Repeating the simulation loop 320 as described above will result in simulating the performance of a roller cone drill bit drilling earth formations with continuous updates of the bottomhole pattern drilled, simulating the actual drilling of the bit in a selected earth formation. Upon completion of a selected number of operations of the simulation loops 320, results of the simulation can be programmed to provide output information at 348 characterizing the performance of the selected drill bit during the simulated drilling, as shown in FIG. 3B. It should be understood that the simulation can be stopped using any other suitable termination indicator, such as a selected axial displacement.

Output information for the simulation may include forces acting on the individual cutting elements during drilling, scraping movement/distance of individual inserts on hole bottom and on the hole wall, forces acting on the individual cones during drilling, total forces acting on the bit during drilling, and the rate of penetration for the selected bit. This output information may be presented in the form of a visual representation 350, such as a visual representation of the hole being drilled in an earth formation where crater sections calculated as being removed during drilling are visually "removed" from the bottom surface of the hole. Such a visual representation of updating bottomhole geometry and presenting it visually is shown, for example, in FIG. 7. Alternatively, the visual representation may include graphs of any of the parameters provided as input, or any or all of the parameters calculated in order to generate the visual representation. Graphs of parameters, for example, may include a graphical display of the axial and/or lateral forces on the different cones, on rows of cutting elements on any or all of the cones, or on individual cutting elements on the drill bit during simulated drilling. The visual representation of drilling may be in the form of a graphic display of the bottomhole geometry presented on a computer screen. However, it should be understood that the invention is not limited to this type of display or any other particular type of display. The means used for visually displaying aspects of simulated drilling is a matter of convenience for the system designer, and is not intended to limit the invention.

Figure 4:
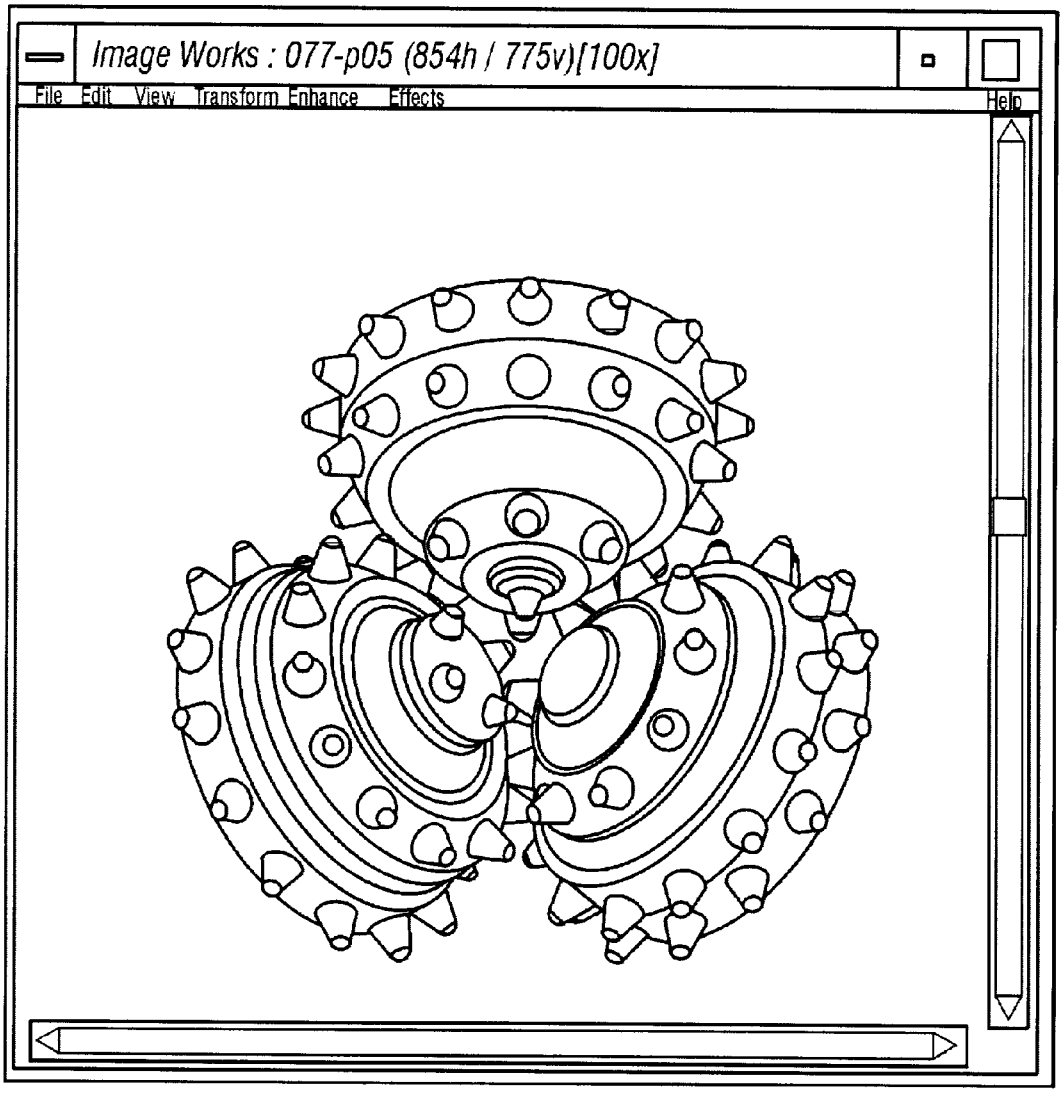
FIG. 4 shows one example of a visual representation of the cones of a roller cone bit generated from input of the bit design parameters converted into visual representation parameters.
Figure 5:
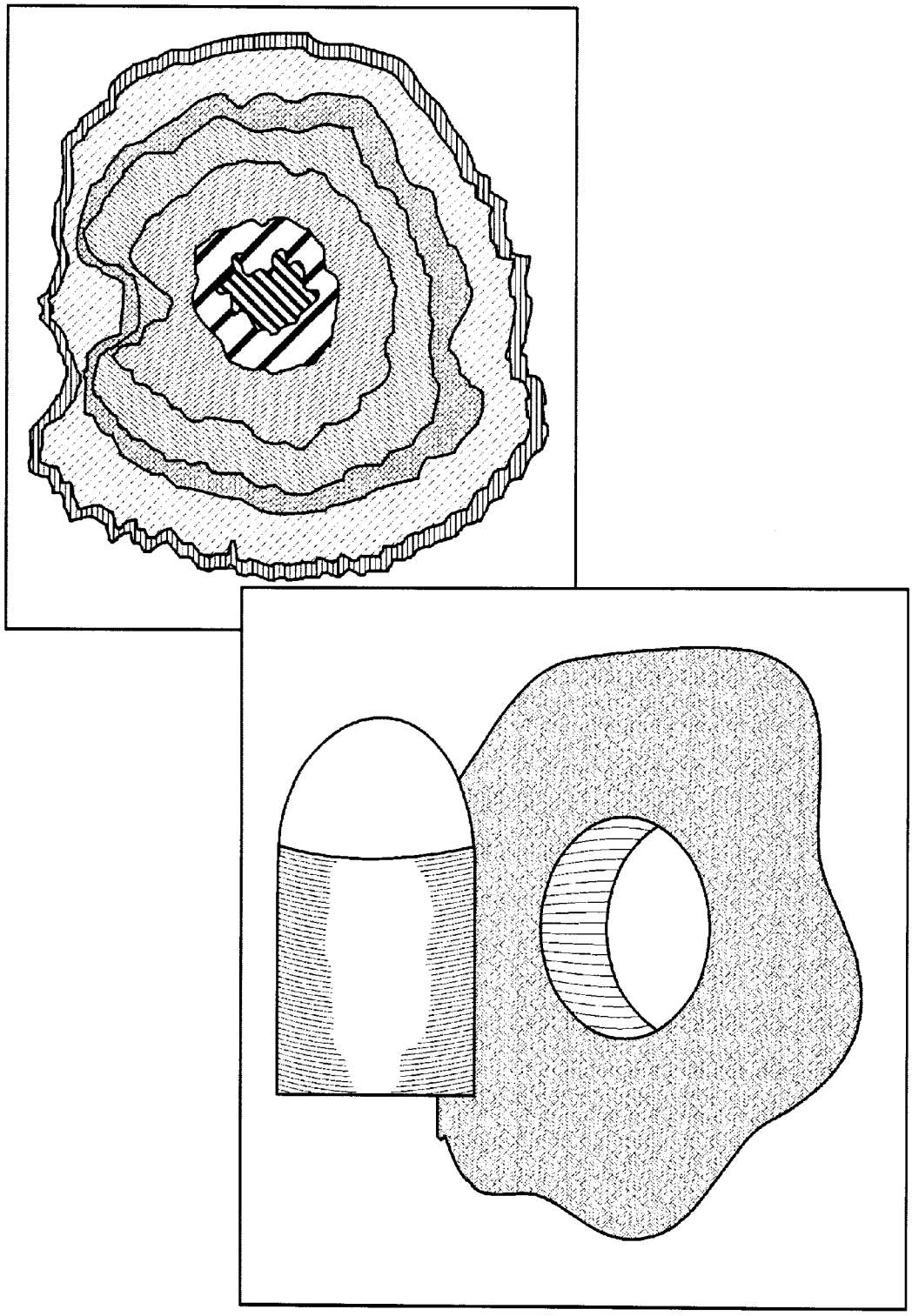
FIG. 5 shows one example of cutting element/earth formation contact characterization, wherein an actual crater in earth formation is digitally characterized for use as cutting element/earth formation interaction data.

Examples of output data converted to visual representations for an embodiment of the invention are provided in FIGS. 4–7. These figures include line renditions representing 3-dimensional objects preferably generated using means such as OPEN GL a 3-dimensional graphics language originally developed by Silicon Graphics, Inc., and now a part of the public domain. This graphics language was used to create executable files for 3-dimensional visualizations. FIG. 4 shows one example of a visual representation of the cones of a roller cone bit generated from defined bit design parameters provided as input for a simulation and converted into visual representation parameters for visual display. Once again, bit design parameters provided as input may be in the form of 3-dimensional CAD solid or surface models. Alternatively, the visual representation of the entire bit, bottomhole surface, or other aspects of the invention may be visually represented from input data or based on simulation calculations as determined by the system designer. FIG. 5 shows one example of the characterization of a crater resulting from the impact of a cutting element onto an earth formation. In this characterization, the actual crater formed in the earth formation as a result of laboratory testing is digitally characterized for use as cutting element/earth formation interaction data, as described below. Such laboratory testing will be further explained.

Figure 6A:
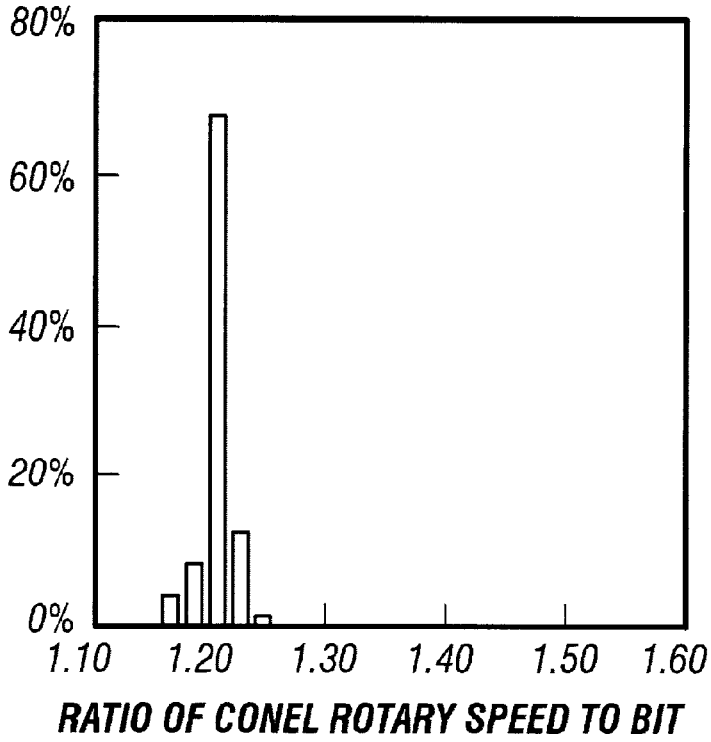
FIGS. 6A–6H show examples of a graphical representations of information obtained from an embodiment of the invention.
Figure 6B:
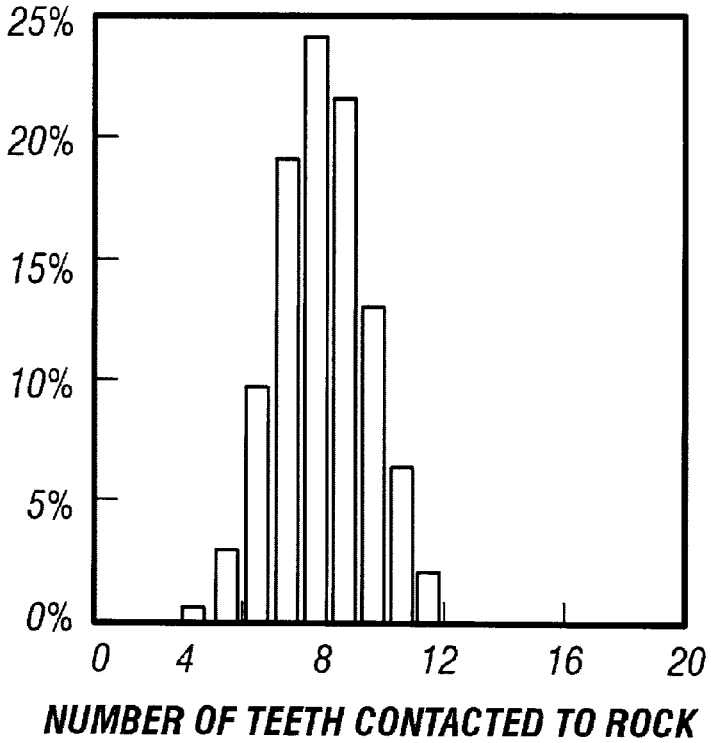
Figure 6C:
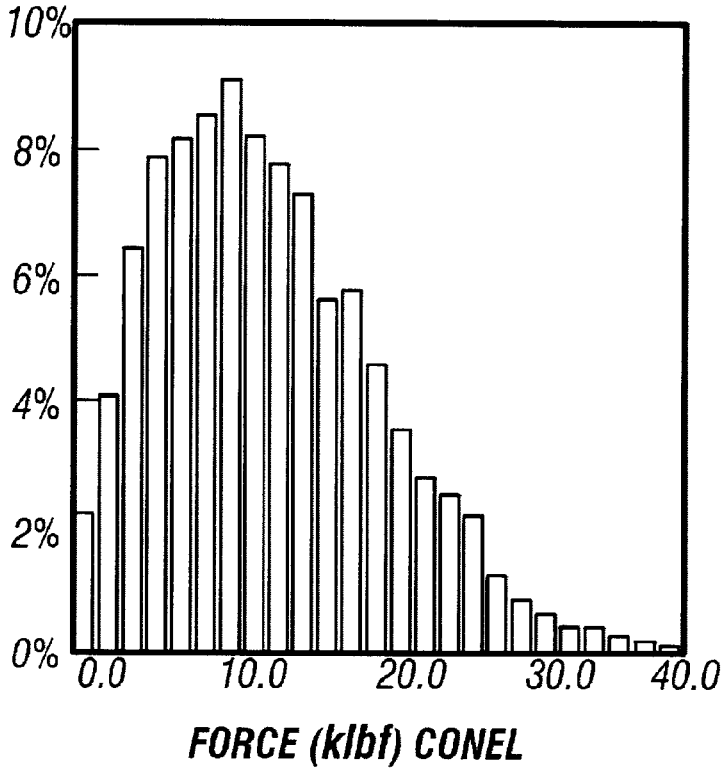
Figure 6D:
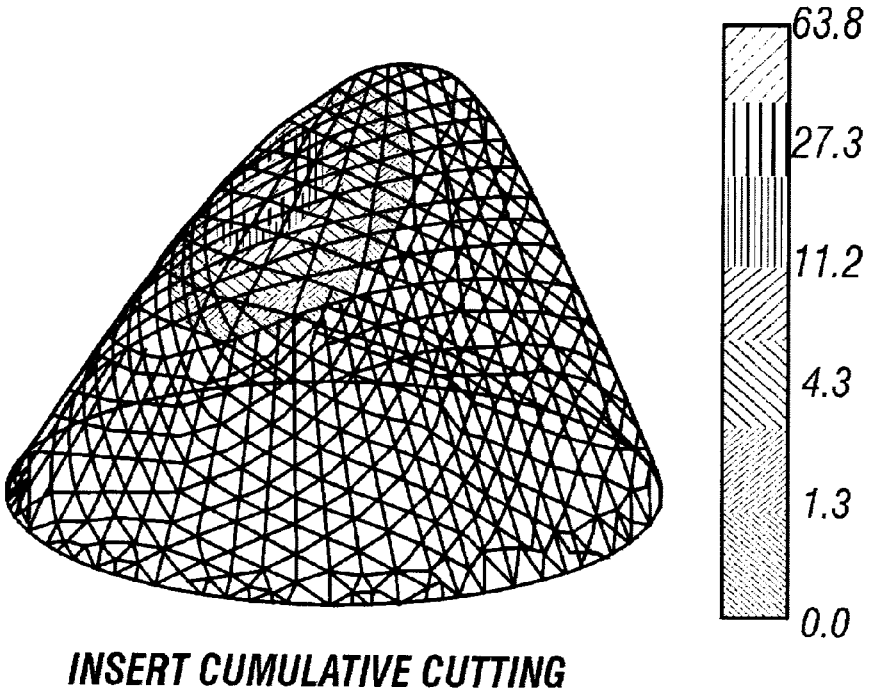
Figure 6E:
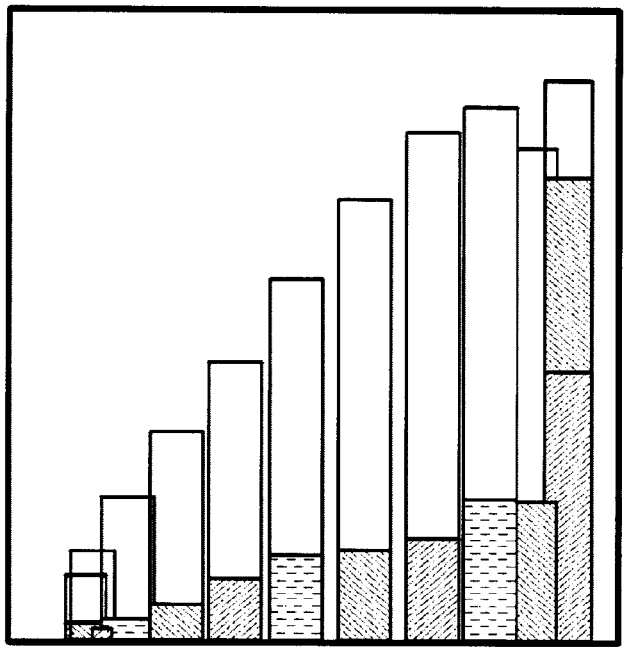
Figure 6F:
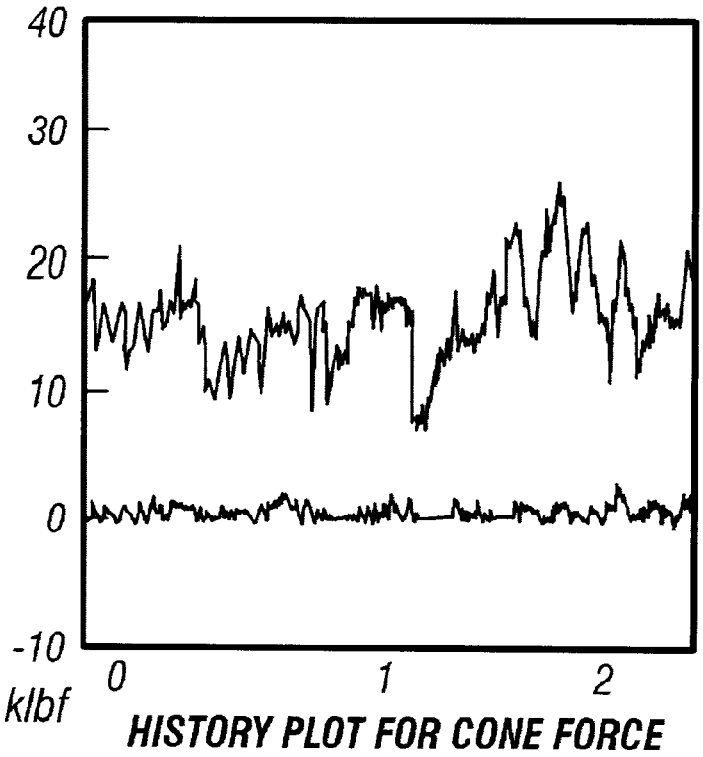
Figure 6G:
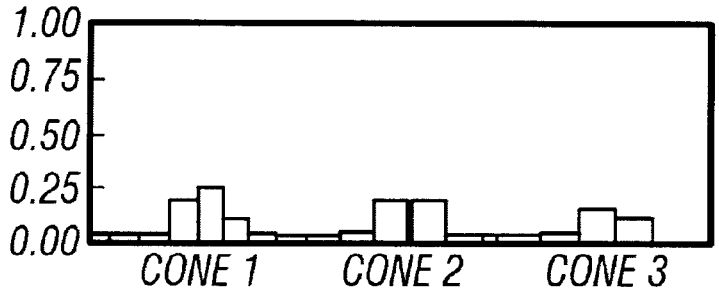
Figure 6G:
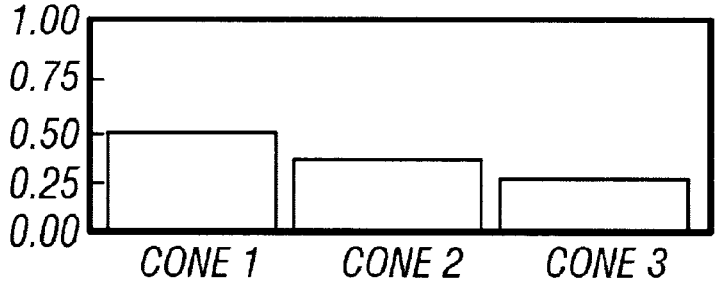
Figure 6H:
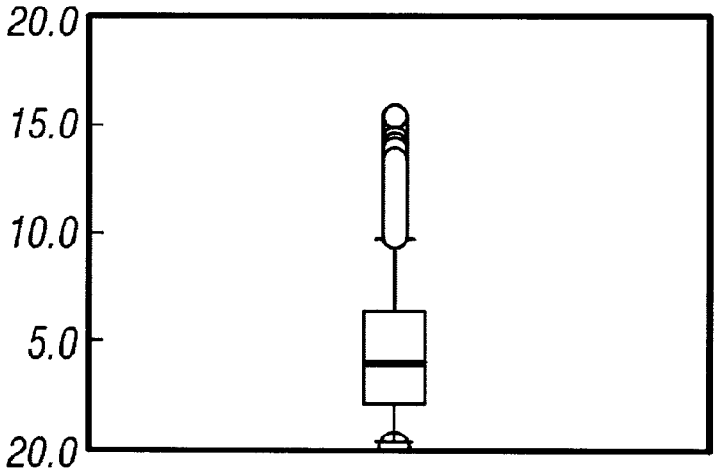

FIGS. 6A–6H show examples of graphical displays of output for an embodiment of the invention. These graphical displays were generated to analyze the effects of drilling on the cones and cutting elements of the bit. The graph in FIG. 6A provides a summary of the rotary speed of cone 1 during drilling. Such graphs can be generated for any of the other cones on the drill bit. The graph in FIG. 6B provides a summary of the number of cutting elements in contact with the earth formation at any given point in time during drilling. The graph in FIG. 6C provides a summary of the forces acting on cone 1 during drilling. Such graphs can be generated for any of the other cones on the drill bit. The graph in FIG. 6D is a mapping of the cumulative cutting achieved by the various sections of the cutting element during drilling displayed on a meshed image of the cutting element. The graph in FIG. 6E provides a summary of the bottom of hole (BOH) coverage achieved during drilling. The graph in FIG. 6F is a plot of the force history of one of the cones. The graph in FIG. 6G is a graphical summary of the force distribution on the cones. The top graph provides a summary of the forces acting on each row of each cone on the bit. The bottom graph in FIG. 6G is a summary of the distribution of force between the cones of the bit. The graph in FIG. 6H provides a summary of the forces acting on the third row of cutting elements on cone 1.

Figure 7:
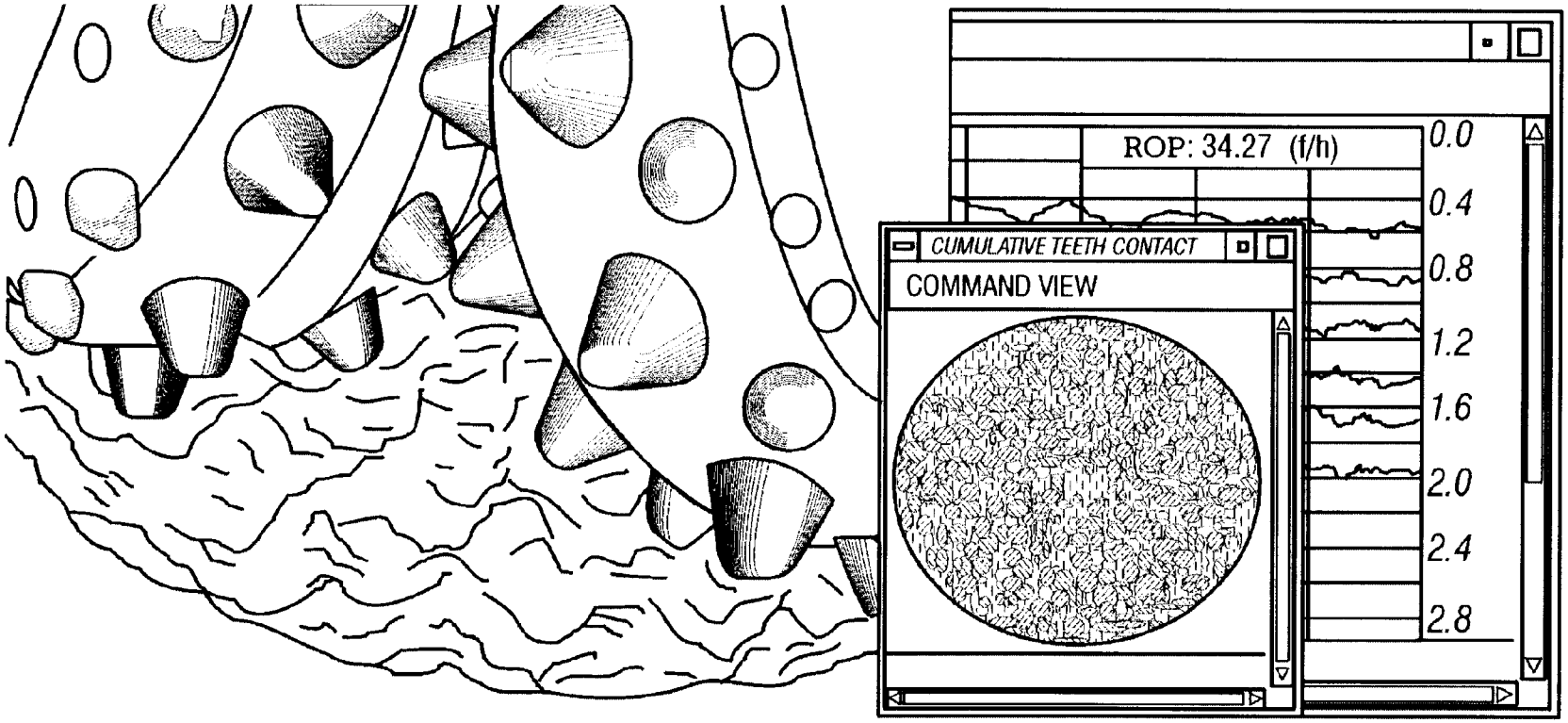
FIG. 7 shows one example of a visual representation of a roller cone bit drilling an earth formation obtained from an embodiment of the invention.

FIG. 7 shows one example of a visual representation of a roller cone bit drilling an earth formation obtained from an embodiment of the invention. The largest of the three cascaded figures in FIG. 7 shows a three dimensional visual display of simulated drilling calculated in accordance with an embodiment of the invention. Clearly depicted in this visual display is the expected earth formation deformation/fracture resulting from the calculated contact of the cutting elements with the earth formation during simulated drilling. This display can be updated in the simulation loop 320 as calculations are carried out, and/or the visual representation parameters used to generate this display may be stored for later display or use as determined by the system designer. It should be understood that the form of display and timing of display is a matter of convenience to be determined by the system designer, and, thus, the invention is not limited to any particular form of visual display or timing for generating the display. Referring back to FIG. 7, the smallest of the cascaded figures in FIG. 7 shows a mapping of cumulative cutting element contact with the bottomhole surface of the earth formation. This figure is a black and white copy of a graphical display, wherein different colors were used to distinguish cutting element contacts associated with different revolutions of the bit. The different colors from the graphical display appearing here as different shades of gray. The last figure of the cascaded figures in FIG. 7 provides a summary of the rate of penetration of the bit. In the example shown, the average rate of penetration calculated for the selected bit in the selected earth formation is 34.72 feet per hour.

FIGS. 4–7 are only examples of visual representations that can be generated from output data obtained using the invention. Other visual representations, such as a display of the entire bit drilling an earth formation, a graphical summary of the force distribution over all cutting elements on a cone, or other visual displays, may be generated as determined by the system designer. Although the visual displays shown, for example, in FIGS. 4–7 have been presented for convenience in black and white, visual displays may be in color. The invention is not limited to the type of visual representation generated.

Cutting Element/Earth Formation Interaction Data

Referring back to the embodiment of the invention shown in FIGS. 3A and 3B, drilling parameters 310, bit design parameters 312, and bottomhole parameters 316 required as input for the simulation loop of the invention are distinctly defined parameters that can be selected in a relatively straight forward manner. On the other hand, cutting element/earth formation interaction data 314 is not defined by a clear set of parameters, and, thus, can be obtained in a number of different ways.

In one embodiment of the invention, cutting element/earth formation interaction data 314 may comprise a library of data obtained from actual tests performed using selected cutting elements, each having known geometry, on selected earth formations. In this embodiment, the tests include impressing a cutting element having known geometry on the selected earth formation with a selected force. The selected earth formation may have known mechanical properties, but it is not essential that the mechanical properties be known. Then the resulting crater formed in the formation as a result of the interaction is analyzed. Such tests are referred to as cutting element impact tests. These tests can be performed for different cutting elements, different earth formations, and different applied forces, and the results analyzed and stored in a library for use by the simulation method of the invention. From such tests it has been determined that deformation resulting from the contact of cutting elements of roller cone bits with earth formations includes plastic deformation and brittle failure (fracture). Thus these impact tests can provide good representation of the interaction between cutting elements and earth formations under selected conditions.

In an impact test, a selected cutting element is impressed on a selected earth formation sample with a selected applied force to more accurately represent bit action. The force applied may include an axial component and/or a lateral component. The cutting element is then removed, leaving behind a crater in the earth formation sample having an interference depth b, for example as shown in FIG. 8A. The resulting crater is then converted to coordinates describing the geometry of the crater. In this example embodiment, the crater is optically scanned to determine the volume and surface area of the crater. Then the shape of the crater is approximated by representing the more shallow section of the crater, resulting mostly from fracture, as a cone, and representing the deeper section of the crater, generally corresponding to the shape of the tip of the cutting element, as an ellipsoid, as shown, as shown, for example, in FIG. 8B. The crater information is then stored in a library along with the known cutting element parameters, earth formation parameters, and force parameters. The test is then repeated for the same cutting element in the same earth formation under different applied loads, until a sufficient number of tests are performed to characterize the relationship between interference depth and impact force applied to the cutting element. Tests are then performed for other selected cutting elements and/or earth formations to create a library of crater shapes and sizes and information regarding interference depth/impact force for different types of cutting elements in selected earth formations. Once interaction data are stored, these data can be used in simulations to predict the expected deformation/fracture crater produced in a selected earth formation by a selected cutting element under specified drilling conditions. Optionally, impact tests may be conducted under confining pressure, such as hydrostatic pressure, to more accurately represent actual conditions encountered while drilling.

Figure 9:
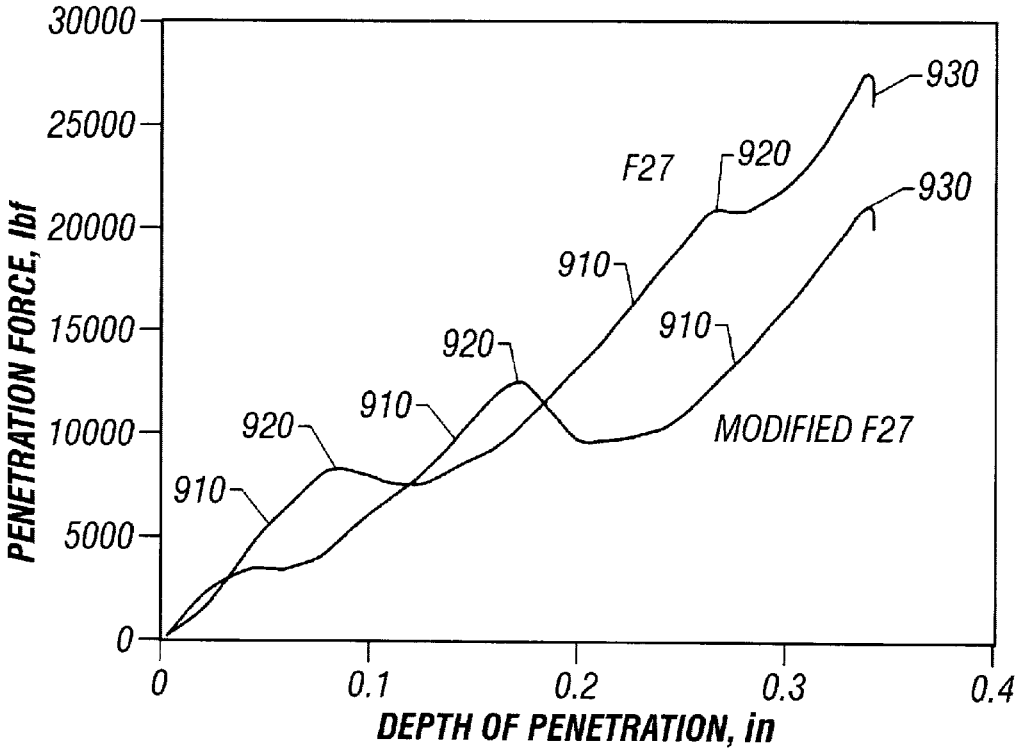
FIG. 9 shows one example of a graphical representation comparing force-depth interaction data for an initial cutting element of an initial bit design with the enhanced force-depth interaction data of a new cutting element of a modified bit design obtained by selectively adjusting a parameter of a bit.

FIG. 9 shows a graph of one example of typical experimental results obtained from impact tests performed using two different insert-type cutting elements in an earth formation. The impact tests were performed under a hydrostatic pressure of 2000 psi to obtain data better representing actual conditions in deep well drilling. The inserts used for the test are identified as "Original Insert" and "Modified Insert" configurations in FIG. 9. Depth/force curves characterize the relationship between interference depth and force for the selected insert in the selected formation. The depth/force curve is typically nonlinear and non-monotonically increasing, as is shown in FIG. 9. The portions of the curves which are monotonically increasing, shown at 910, generally indicate penetration resulting from plastic deformation of the earth formation. The drops 920 that periodically occur in the curves indicate the onset of fracturing in the earth formation. The final peak 930 of the curves indicates that full cutting element depth has been reached, at which point, no further penetration results from increasing the force applied to the cutting element.

To obtain a complete library of cutting element/earth formation interaction data, subsequent impact tests are performed for each selected cutting element and earth formation up to the drop-off value (i.e., maximum depth of penetration of the cutting element) to capture crater size at the particular depth/force. The entire depth/force curve is then digitized and stored. Linear interpolation, or other type of best-fit function, can be used in this embodiment to obtain depth of penetration values for force values between measurement values experimentally obtained. The interpolation method used is a matter of convenience for the system designer, and is not a limitation of the invention. As previously explained, it is not necessary to know the mechanical properties of any of the earth formations for which impact testing are performed in order to use the results of impact testing on those particular formations to simulate drilling according to this invention. However, if formations which are not tested are to have drilling simulations performed for them, it is preferable to characterize mechanical properties of the tested formations so that expected cutting element/formation interaction data can be interpolated for such untested formations. As is well known in the art, the mechanical properties of earth formations include, for example, Young's modulus, Poisson's ration and elastic modulus, among others. The particular properties selected for interpolation are not limited to these properties.

Referring back to FIGS. 3A and 3B, in one embodiment of the invention, cutting element/earth formation interaction data are obtained from impact tests as described above. In this embodiment, the interaction data corresponding to the selected type of cutting element used on the bit and the properties of the selected earth formation to be drilled are provided as input into the simulation, along with other described input data. Then the simulated drill bit is "rotated" and "moved" downward by the selected increment. The new locations of the cutting elements are calculated and then their interference with the bottomhole pattern is computed to determine the penetration depth of each cutting element, as well as its interference projection areas (i.e., fractional contact area resulting form subsequent contact with the formation surface containing partial craters formed by previous cutting element contacts). Then based on the calculated depth of penetration, interference projection areas and cutting element/earth formation interaction data, the vertical forces on each cutting element are calculated.

Using impact tests to experimentally obtain cutting element/earth formation interaction provides several advantages. One advantage is that impact tests can be performed under simulated drilling conditions, such as under confining pressure to better represent actual conditions encountered while drilling. Another advantage is that impact tests can provide data which accurately characterize the true interaction between an actual cutting element and an actual earth formation. Another advantage is that impact tests are able to accurately characterize the plastic deformation and brittle fracture components of earth formation deformation resulting from interaction with a cutting element. Another advantage is that it is not necessary to determine all mechanical properties of an earth formation to determine the interaction of a cutting element with the earth formation. Another advantage is that it is not necessary to develop complex analytical models for approximating the behavior of an earth formation based on the mechanical properties of a cutting element and forces exhibited by the cutting element during interacting with the earth formation.

However, in another embodiment of the invention, cutting element/earth formation interaction could be characterized using numerical analysis, such as Finite Element Analysis, Finite Difference Analysis, and Boundary Element Analysis. For example, the mechanical properties of an earth formation may be measured, estimated, interpolated, or otherwise determined, and the response of the earth formation to cutting element interaction calculated using Finite Element Analysis. It should be understood that characterizing the formation/cutting element interaction according to the invention is not limited to these analytical methods. Other analytical methods may be used as determined by the system designer.

In using the cutting element/formation interaction data in the calculation of the axial force on each cutting element, the depth of penetration is calculated for each cutting element and the corresponding impact force acting on the cutting element is obtained from the depth/force interaction curve. Based on the simplifying assumption that the fraction of the total contact area (interference projection area/total contact surface area) in actual contact with the formation is equal to the fraction of the total force (reduced force due to partial impact/total force from complete contact), this impact force is then multiplied by the fraction of the total contact area to obtain the net resulting force on the cutting element. The calculations are repeated, iteratively, to obtain the resulting force acting on each cutting element, until the vertical force on each cutting element is obtained. Then the vertical forces acting on each cutting element are summed to obtain the total force acting on the cutting elements in the axial direction, as previously explained.

Once the axial forces are calculated, the axial forces on the cutting elements are summed and compared to the WOB. As previously described, if the total vertical force acting on the cutting elements is greater than the WOB, the axial displacement of the bit is reduced and the forces recalculated. The procedure of interatively recalculating the axial displacement and resulting vertical force is continued until the vertical force approximately matches the specified WOB. Once a solution for the incremental vertical displacement corresponding to the incremental rotation is obtained, the lateral movement of the cutting elements based on the previous and current cutting element locations new cutting element locations are calculated and then the lateral forces on the cutting elements are calculated based on the cutting element/earth formation interaction test data and lateral movement of the cutting elements. Then the cone rotation speed is calculated, the bottomhole pattern updated to correspond to the predicted cutting element interaction, by superimposing fracture craters (their geometry determined based on cutting element/earth formation interaction data) resulting from interference with cutting elements during the current incremental drilling step on the existing geometry of the earth formation surface.

Method for Designing a Roller Cone Bit

In another aspect, the invention provides a method for designing a roller cone bit. In one embodiment, this method includes selecting an initial bit design, calculating the performance of the initial bit design, then adjusting one or more design parameters and repeating the performance calculations until an optimal set of bit design parameters is obtained. In another embodiment, this method can be used to analyze relationships between bit design parameters and drilling performance of a bit. In a third embodiment, the method can be used to design roller cone bits having enhanced drilling characteristics. In particular, the method can be used to analyze row spacing optimization, intra-insert spacing optimization, the balance of lateral forces between cones and between rows, and the optimized axial force distribution among different cones, rows, and cutting elements in the same row.

Figure 10A:
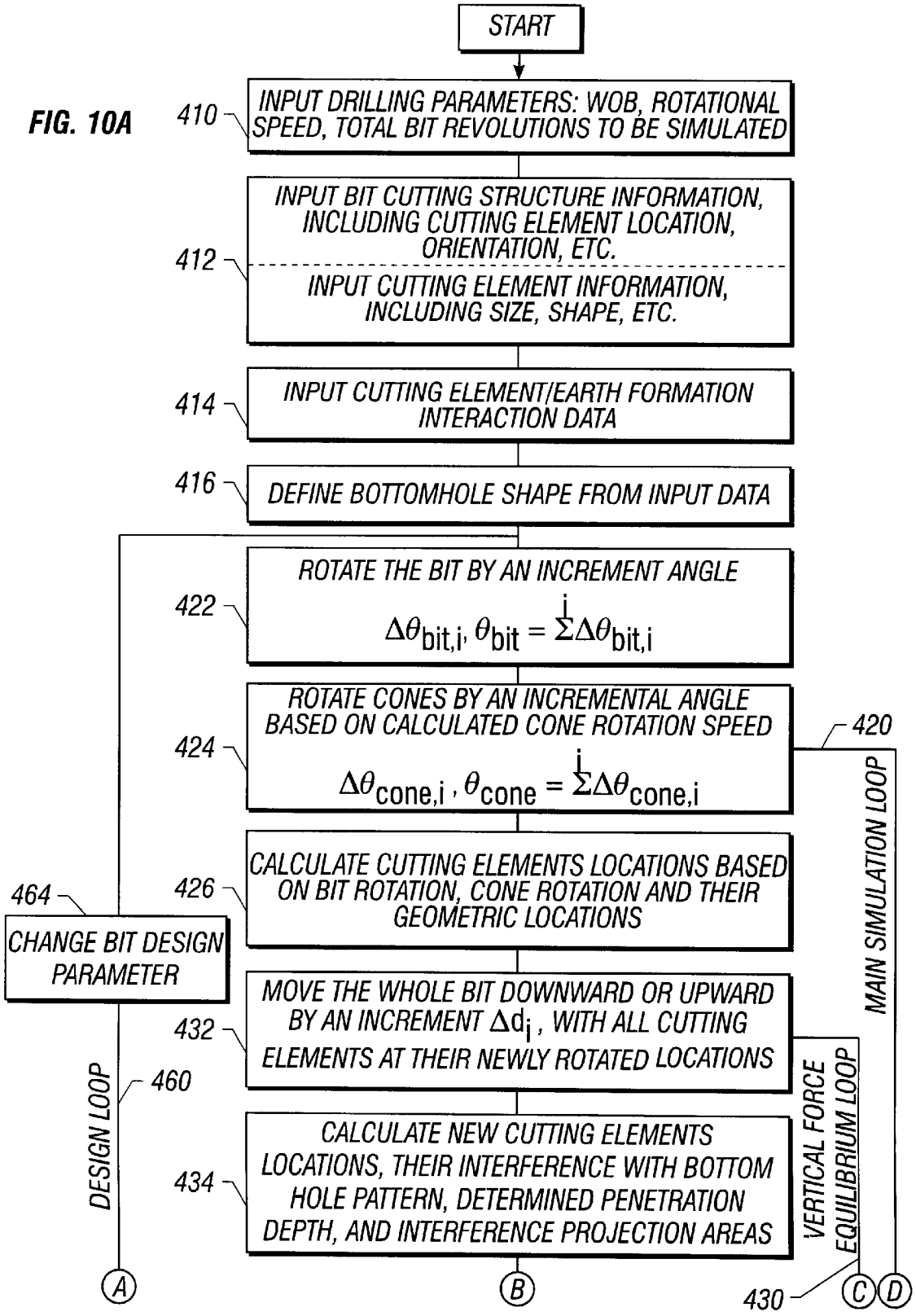
FIG. 10A and FIG. 10B show a flowchart of an embodiment of the invention for designing roller cone bits.
Figure 10B:
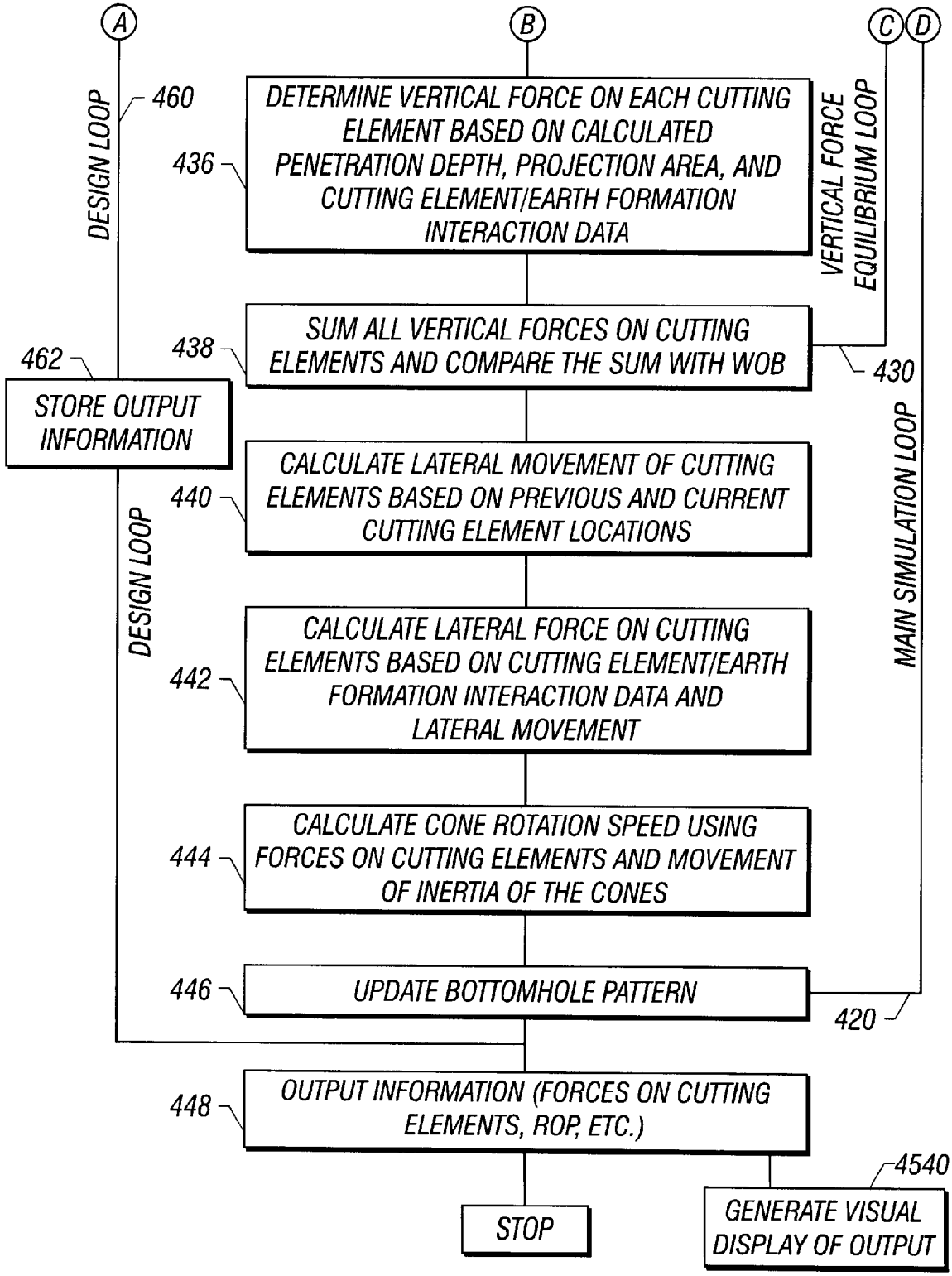

FIGS. 10A and 10B show a flow chart for one embodiment of the invention used to design roller cone drill bits. In this embodiment, the initial input parameters include drilling parameters 410, bit design parameters 412, cutting element/earth formation interaction data 414, and bottomhole geometry data 416. These parameters are substantially the same as described above in the first embodiment of FIGS. 3A and 3B.

As shown in FIGS. 10A and 10B, once the input parameters are entered or otherwise made available, the operations in the design loop 460 can be carried out. First in the design loop 460 is a main simulation loop 420 which comprises calculations for incrementally simulating a selected roller cone bit drilling a selected earth formation. The calculations performed in this simulation loop 420 are substantially the same as described in detail above. In the main simulation loop 420, the bit is "rotated" by an incremental angle, at 422, and the corresponding vertical displacement is iteratively determined in the axial force equilibrium loop 430. Once the axial displacement is obtained, the resulting lateral displacement and corresponding lateral forces for each cutting element are calculated, at 440 and 442, and used to determine the current rotation speed of the cones, at 444. Finally, the bottomhole geometry is updated, at 446. The calculations in the simulation loop 420 are repeated for successive incremental rotations of the bit until termination of the simulation is indicated.

Once the simulation loop 420 in the design loop 460 is completed, selective calculation results from the simulation loop can be stored as output information, 462 for the initial bit design. Then one or more bit design parameters, initially provided as input, is selectively adjusted (changed) 464, as further explained below, and the operations in the design loop 460 are then repeated for the adjusted bit design. The design loop 460 may be repeated until an optimal set of bit design parameters is obtained, or until a bit design exhibiting enhanced drilling characteristics is identified. Alternatively, the design loop 460 may be repeated a specified number of times or, until terminated by instruction from the operator or by other operation. Repeating the design loop 460, as described above, will result in a library of stored output information which can be used to analyze the drilling performance of multiple bits designs drilling earth formations.

Parameters that may be altered at 464 in the design loop 460 include cutting element count, cutting element spacing cutting element location, cutting element orientation, cutting element height, cutting element shape, cutting element profile, bit diameter, cone diameter profile, row spacing on cones, and cone axis offset with respect to the axis of rotation of the bit. However, it should be understood that the invention is not limited to these particular parameter adjustments. Additionally, bit parameter adjustments may be made manually by operator after completion of each simulation loop 420, or, alternatively, programmed by the system designer to automatically occur within the design loop 460. For example, one or more selected parameters maybe incrementally increased or decreased with a selected range of values for each iteration of the design loop 460. The method for adjusting bit design parameters is a matter of convenience for the system designer. Therefore, other methods for adjusting parameters may be employed as determined by the system designer. Thus, the invention is not limited to a particular method for adjusting bit design parameters.

An optimal set of bit design parameters may be defined as a set of bit design parameters which produces a desired degree of improvement in drilling performance, in terms of rate of penetration, cutting element wear, optimal axial force distribution between cones, between rows, and between individual cutting elements, and/or optimal lateral forces distribution on the bit. For example, in one case, axial forces may be considered optimized when axial forces exerted on the cones are substantially balanced. In one case, lateral forces may be considered optimized when lateral forces are substantially balanced to improve drilling performance. Drilling characteristics used to determine improved drilling performance can be provided as output data and analyzed upon completion of each simulation loop 420, or the design loop 460. Drilling characteristics that may be considered in the analysis of bit designs may include, a maximum ROP, a more balanced distribution of axial forces between cones, an optimized distribution of axial forces between the rows on a cone, a more uniform distribution of forces about the contact surface area of cutting elements.

For example, it may be desirable to optimize forces between particular rows of cutting elements or between the cones. During execution or after termination of the design loop 460, results for the drilling simulation of each bit design or selective bit designs, can be provided as output information 448. The output information 448 may be in the form of data characterizing the drilling performance of each bit, data summarizing the relationship between bit designs and parameter values, data comparing drilling performances of the bits, or other information as determined by the system designer. The form in which the output is provided is a matter of convenience for a system designer or operator, and is not a limitation of the present invention.

Output information that may be considered in identifying bit designs possessing enhanced drilling characteristics or an optimal set of parameters includes: rate of penetration, cutting element wear, forces distribution on the cones, force distribution on cutting elements, forces acting on the individual cones during drilling, total forces acting on the bit during drilling, and the rate of penetration for the selected bit. This output information may be in the form of visual representation parameters calculated for the visual representation of selected aspects of drilling performance for each bit design, or the relationship between values of a bit parameter and the drilling performance of a bit. Alternatively, other visual representation parameters may be provided as output as determined by the operator or system designer. Additionally, the visual representation of drilling may be in the form of a visual display on a computer screen. It should be understood that the invention is not limited to these types of visual representations, or the type of display. The means used for visually displaying aspects of simulated drilling is a matter of convenience for the system designer, and is not intended to limit the invention.

As set forth above, the invention can be used as a design tool to simulate and optimize the performance of roller cone bits drilling earth formations. Further the invention enables the analysis of drilling characteristics of proposed bit designs prior to their manufacturing, thus, minimizing the expensive of trial and error designs of bit configurations. Further, the invention permits studying the effect of bit design parameter changes on the drilling characteristics of a bit and can be used to identify bit design which exhibit desired drilling characteristics. Further, it has been shown that use of the invention leads to more efficient designing of bits having enhanced performance characteristics.

Method for Optimizing Drilling Parameters of a Roller Cone Bit

In another aspect, the invention provides a method for optimizing drilling parameters of a roller cone bit, such as, for example, the weight on bit (WOB) and rotational speed of the bit (RPM). In one embodiment, this method includes selecting a bit design, drilling parameters, and earth formation desired to be drilled; calculating the performance of the selected bit drilling the earth formation with the selected drilling parameters; then adjusting one or more drilling parameters and repeating drilling calculations until an optimal set of drilling parameters is obtained. This method can be used to analyze relationships between bit drilling parameters and drilling performance of a bit. This method can also be used to optimize the drilling performance of a selected roller cone bit design.

Figure 11A:
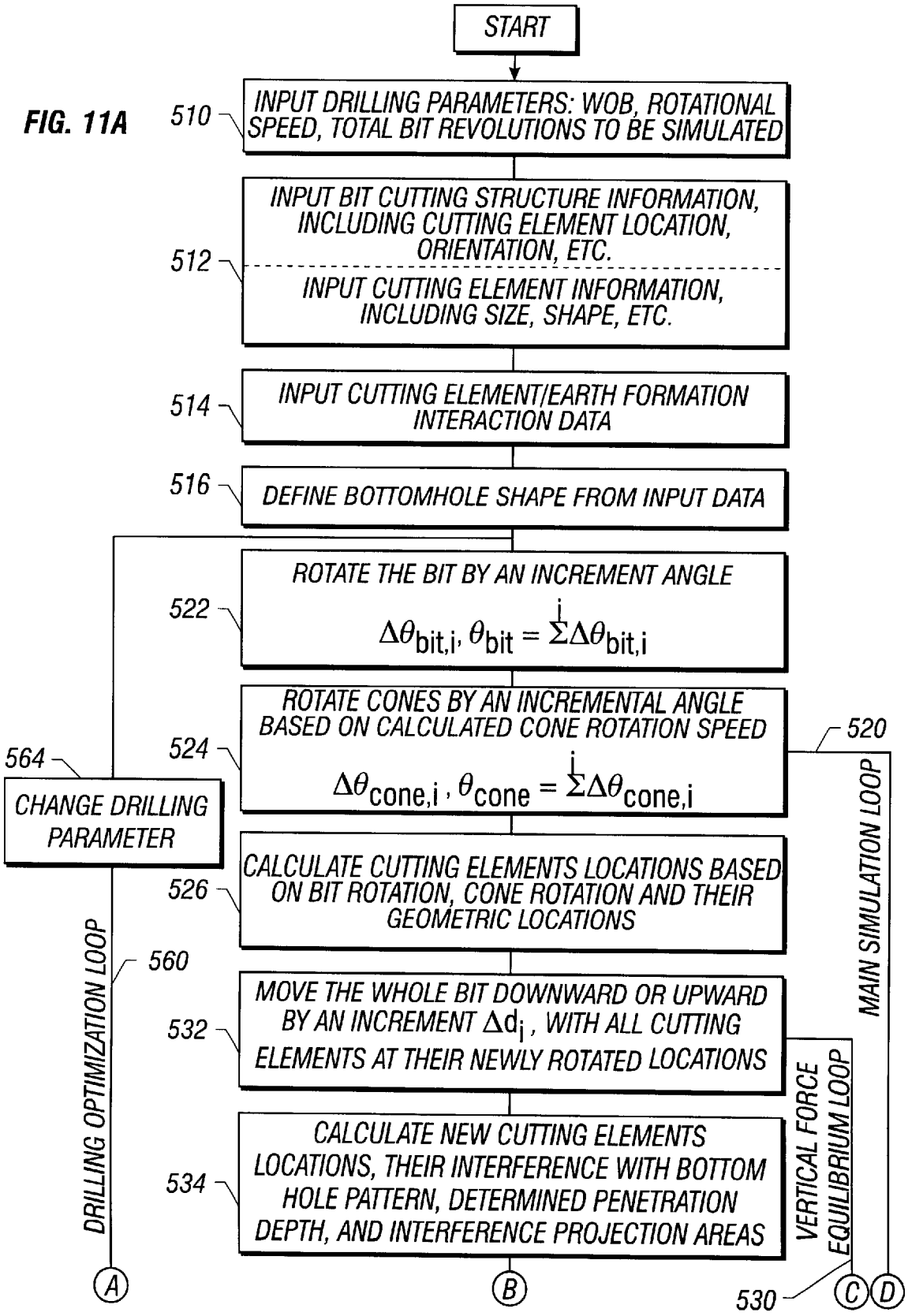
FIG. 11A and FIG. 11B show a flowchart of an embodiment of the invention for optimizing drilling parameters of a roller cone bit drilling an earth formation.
Figure 11B:
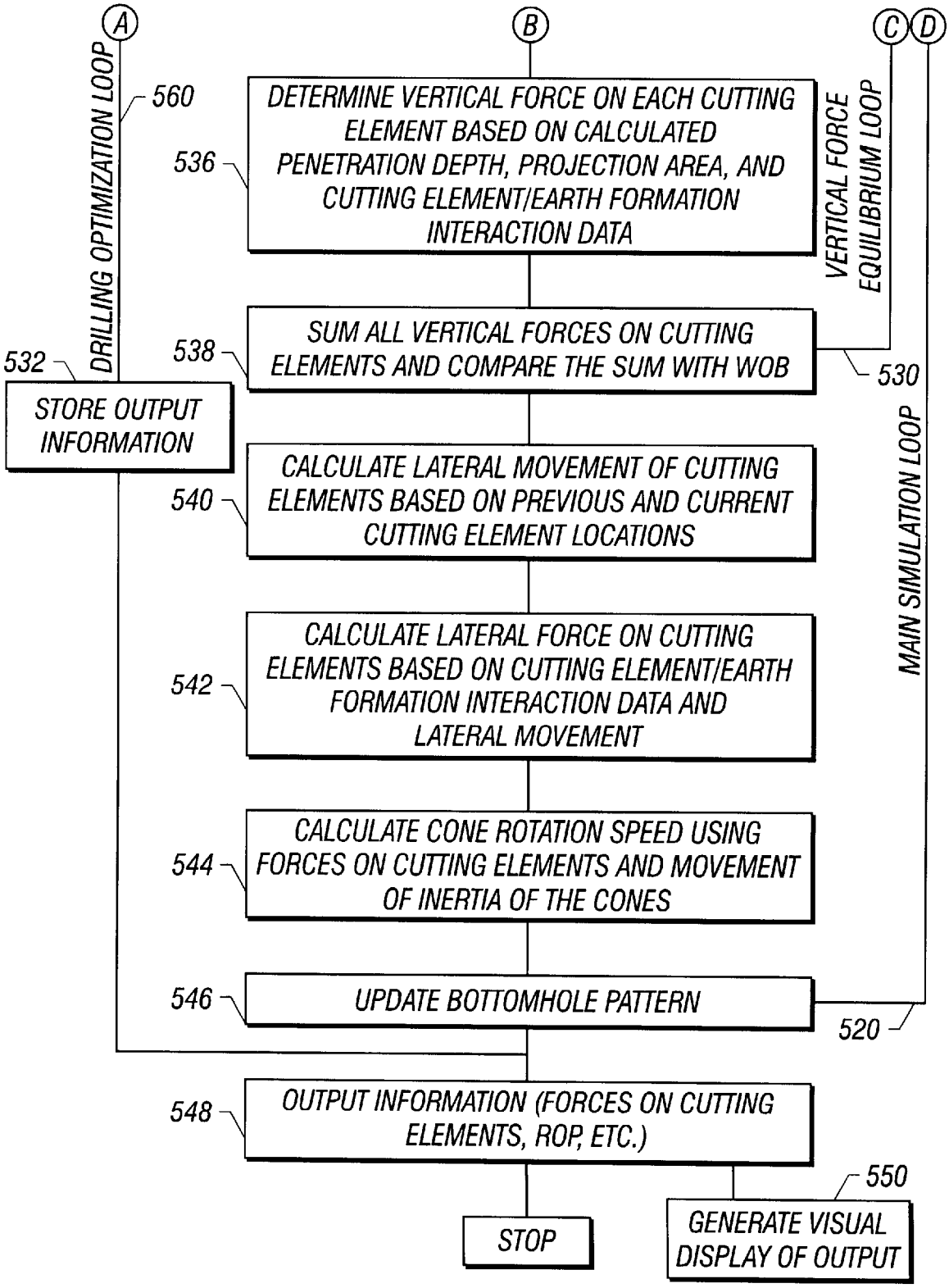

FIGS. 11A and 11B show a flow chart for one embodiment of the invention used to design roller cone drill bits. In this embodiment, the initial input parameters include drilling parameters 510, bit design parameters 512, cutting element/earth formation interaction data 514, and bottomhole geometry data 516. These input parameters 510, 512, 514, 516 are substantially the same as the input put parameters described above in the first embodiment of FIGS. 3A and 3B.

As shown in FIGS. 11A and 11B, once the input parameters are entered or otherwise made available, the operations in the drilling optimization loop 560 can be carried out. First in the drilling optimization loop 560 is a main simulation loop 520 which comprises calculations for incrementally simulating a selected roller cone bit drilling a selected earth formation. The calculations performed in this simulation loop 520 are substantially the same as described in detail above. In the main simulation loop 520, the bit is "rotated" by an incremental angle, at 522, and the corresponding vertical displacement is iteratively determined in the axial force equilibrium loop 530. Once the axial displacement is obtained, the resulting lateral displacement and corresponding lateral forces for each cutting element are calculated, at 540 and 542, and used to determine the current rotation speed of the cones, at 544. Finally, the bottomhole geometry is updated, at 546. The calculations in the simulation loop 520 are repeated for successive incremental rotations of the bit until termination of the simulation is indicated.

Once the simulation loop 520 is completed, selective results from the simulation loop can be stored as output information 562. Then one or more drilling parameters, initially provided as input, is selectively adjusted 564, as further explained below, and the operations in the drilling optimization loop 560 are then repeated for the adjusted drilling conditions. The drilling optimization loop 560 may be repeated until an optimal set of drilling parameters is obtained, or a desired relationship between drilling parameters and drilling performance is characterized. Alternatively, the drilling optimization loop 560 may be repeated a specified number of times or, until terminated by instruction from the operator or by other operation. Repeating the drilling optimization loop 560, as described above, will result in a library of stored output information which can be used to analyze the relationship between drilling parameters and the drilling performance of a selected bit designs drilling earth formations.

Drilling parameters that may be altered at 564 in the drilling optimization loop 560 include weight on bit, rotational speed of bit, mud flow volume, and torque applied to bit. However, it should be understood that the invention is not limited to these particular parameter adjustments. Drilling parameter adjustments may be made manually by an operator after completion of each simulation loop 520, or, alternatively, programmed by the system designer to automatically occur within the drilling optimization loop 560. For example, one or more selected parameters maybe incrementally increased or decreased with a selected range of values for each iteration of the drilling optimization loop 560. The method for adjusting drilling parameters is a matter of convenience for the system designer. Therefore, other methods for adjusting parameters may be used as determined by the system designer. Thus, the invention is not limited to a particular method for adjusting drilling parameters.

An optimal set of drilling parameters may be defined as a set of drilling parameters which produces optimal drilling performance for a given bit design. Optimal drilling performance may defined, for example, in terms of rate of penetration or cutting element wear. Such features can be provided as output data and analyzed upon completion of each simulation loop 520, or the drilling optimization loop 560. However it should be noted that the definition of optimal drilling performance is not limited to these terms, but may be based on other drilling factors as determined by the system designer.

During execution or after termination of the drilling optimization loop 560, results for the drilling simulation of each set of drilling parameters, can be provided as output information 548. The output information 548 may be in the form of data characterizing the drilling performance of the bit for each set of drilling parameters, data summarizing the relationship between drilling parameter values and drilling performance, data comparing drilling performances of the bit for each set of drilling parameters, or other information as determined by the system designer. The form in which the output is provided is a matter of convenience for a system designer or operator, and is not a limitation of the present invention.

Output information that may be considered in identifying optimal set of drilling parameters includes: rate of penetration, cutting element wear, forces on the cones, force on cutting elements, and total force acting on the bit during drilling. This output information may be in the form of visual representation parameters calculated for the visual representation of selected aspects of drilling performance for each set of drilling parameters, or the relationship between values of a drilling parameter and the drilling performance of the bit. Alternatively, other visual representation parameters may be provided as output as determined by the operator or system designer. Additionally, the visual representation of drilling may be in the form of a visual display on a computer screen. However, it should be understood that the invention is not limited to these types of visual representations, or the type of display. The means used for visually displaying aspects of simulated drilling is a matter of convenience for the system designer, and is not intended to limit the invention.

As described above, the invention can be used as a design tool to simulate and optimize the performance of roller cone bits drilling earth formations. The invention enables the analysis of drilling characteristics of proposed bit designs prior to their manufacturing, thus, minimizing the expensive of trial and error designs of bit configurations. The invention enables the analysis of the effects of adjusting drilling parameters on the drilling performance of a selected bit design. Further, the invention permits studying the effect of bit design parameter changes on the drilling characteristics of a bit and can be used to identify bit design which exhibit desired drilling characteristics. Further, the invention permits the identification an optimal set of drilling parameters for a given bit design. Further, use of the invention leads to more efficient designing and use of bits having enhanced performance characteristics and enhanced drilling performance of selected bits.

The invention has been described with respect to preferred embodiments. It will be apparent to those skilled in the art that the foregoing description is only an example of the invention, and that other embodiments of the invention can be devised which will not depart from the spirit of the invention as disclosed herein. Accordingly, the invention shall be limited in scope only by the attached claims.

What is claimed is:

1. A method for generating a visual representation of a roller cone bit drilling in earth formations, comprising:

selecting bit design parameters, comprising at least a geometry of a cutting element on said bit;

selecting drilling parameters, comprising at least an axial force on said bit;

selecting an earth formation to be represented as drilled;

calculating from said selected drilling parameters, said selected bit design parameters and said earth formation, parameters for a crater formed when one of a plurality of said cutting elements contacts said earth formation;

calculating a bottomhole geometry, wherein said crater is removed from a bottomhole surface;

simulating incrementally rotating said bit, and repeating said calculating of said crater parameters and said bottomhole geometry based on calculated roller cone rotation speed and geometrical location with respect to rotation of said roller cone drill bit about its axis; and converting said crater parameters and said bottomhole geometry parameters into said visual representation.

2. The method as defined in claim 1, wherein said bit design parameters comprise cutting element and roller cone geometry forming part of a computer aided design file comprising design models of said bit.

3. The method as defined in claim 2, wherein said cutting element and roller cone geometry are converted to coordinates prior to entry into said method.

4. The method as defined in claim 1, wherein said bit design parameters comprise at least one of cutting element count, cutting element height, cutting element geometrical shape, cutting element spacing, cutting element location, cutting element orientation, cone axis offset, cone diameter profile, and bit diameter.

5. The method as defined in claim 1, wherein said drilling parameters comprise at least one of axial force on said bit and rotational speed of the bit.

6. The method as defined in claim 1, wherein said calculated crater parameters are derived from laboratory tests comprising a cutting element having selected geometry being impressed on an earth formation sample with a selected force, said tests generating at least a correspondence between penetration depth of said cutting element into said formation and said selected force.

7. The method as defined in claim 6, wherein said selected force comprises an axial component.

8. The method as defined in claim 6, wherein said selected force comprises a lateral component.

9. The method as defined in claim 6, wherein said tests are conducted under selected confining pressure.

10. The method as defined in claim 6, wherein said laboratory tests are interpolated to enable selection of earth formations having properties and bit design parameters having values intermediate of ones used in said laboratory tests.

11. The method as defined in claim 6, wherein craters created in said laboratory tests are converted to coordinates describing a geometry thereof, and said coordinates are selected to define a cross-section, said cross-section forming a principal input for said calculated crater parameters.

12. The method as defined in claim 1, wherein said calculated crater parameters are determined from numerical analysis of penetration of a cutting element having a known geometry impressed on a earth formation having known mechanical properties with a selected force.

13. The method as defined in claim 12, wherein said selected force comprises an axial component.

14. The method as defined in claim 12, wherein said selected force comprises a lateral component.

15. The method as defined in claim 12, wherein said numerical analysis comprises finite element analysis.

16. The method as defined in claim 12, wherein said numerical analysis comprises finite difference analysis.

17. The method as defined in claim 12, wherein said numerical analysis comprises boundary element analysis.

18. The method as defined in claim 1, wherein an axial movement corresponding to said incremental rotation of said bit is determined wherein a sum of axial forces on all of said plurality of cutting elements approximately equals said selected axial force on said bit.

19. The method as defined in claim 1, wherein said visual representation comprises a graph representing axial force on one of said plurality of cutting elements.

20. The method as defined in claim 1, wherein said visual representation comprises a graph representing axial force on a row of said plurality of cutting elements disposed on a roller cone on said bit.

21. The method as defined in claim 1, wherein said visual representation comprises a graph representing axial force on one of a plurality of roller cones on said bit.

22. The method as defined in claim 1, wherein said visual representation comprises a graphic display of said bottomhole geometry.

23. A method for designing a roller cone drill bit, comprising:

selecting initial bit design parameters, comprising at least a geometry of a cutting element on said bit;

selecting drilling parameters, comprising at least an axial force on said bit;

selecting an earth formation to be represented as drilled;

calculating from said selected drilling parameters, said selected bit design parameters and said earth formation, parameters for a crater formed when one of a plurality of said cutting elements contacts said earth formation;

calculating a bottomhole geometry, wherein said crater is removed from a bottomhole surface;

simulating incrementally rotating said bit, and repeating said calculating of said crater parameters and said bottomhole geometry based on calculated roller cone rotation speed and geometrical location with respect to rotation of said roller cone drill bit about its axis; and adjusting at least one of said initial bit design parameters, and repeating said calculating said crater parameters, said bottom hole geometry and said simulated incrementally rotating until an optimal set of said bit design parameters is obtained.

24. The method as defined in claim 23, wherein said optimal set of bit design parameters is determined when lateral forces are substantially optimized to improve drilling performance.

25. The method as defined in claim 23, wherein said optimal set of bit design parameters is determined when axial forces exerted by said cutting elements on each individual cone of said roller cone bit are substantially balanced.

26. The method as defined in claim 25, wherein lateral forces are substantially optimized to improve drilling performance.

27. The method as defined in claim 23, wherein said optimal set of bit design parameters is determined when lateral forces exerted by said cutting elements on each individual cone of said roller cone bit are substantially balanced.

28. The method as defined in claim 23, wherein said optimal set of bit design parameters is determined when maximum rate of penetration is attained for said selected axial force on said bit.

29. The method as defined in claim 23, wherein said bit design parameters comprise cutting element and roller cone geometry forming part of a computer aided design file comprising design models of said bit.

30. The method as defined in claim 29, wherein said cutting element and roller cone geometry are converted to coordinates prior to entry into said method.

31. The method as defined in claim 23, wherein said bit design parameters comprise at least one of cutting element count, cutting element height, cutting element geometrical shape, cutting element spacing, cutting element location, and cutting element orientation, cone axis offset, cone diameter profile, bit diameter.

32. The method as defined in claim 23, wherein said drilling parameters comprise at least one of axial force on said bit and rotational speed of said bit.

33. The method as defined in claim 23, wherein said calculated crater parameters are derived from laboratory tests comprising a cutting element having selected geometry being impressed on an earth formation sample with a selected force, said tests generating at least a correspondence between penetration depth of said cutting element into said formation and said selected force.

34. The method as defined in claim 33, wherein said selected force comprises an axial component.

35. The method as defined in claim 33, wherein said selected force comprises a lateral component.

36. The method as defined in claim 33, wherein said tests are conducted under selected confining pressure.

37. The method as defined in claim 33, wherein said laboratory tests are interpolated to enable selection of earth formations having properties and bit design parameters having values intermediate of ones used in said laboratory tests.

38. The method as defined in claim 33, wherein craters created in said laboratory tests are converted to coordinates describing a geometry thereof, and said coordinates are selected to define a cross-section, said cross-section forming a principal input for said calculated crater parameters.

39. The method as defined in claim 23, wherein said calculated crater parameters are determined from numerical analysis of penetration of a cutting element having a known geometry impressed on a earth formation having known mechanical properties with a selected force.

40. The method as defined in claim 39, wherein said selected force comprises an axial component.

41. The method as defined in claim 39, wherein said selected force comprises a lateral component.

42. The method as defined in claim 39, wherein said numerical analysis comprises finite element analysis.

43. The method as defined in claim 39, wherein said numerical analysis comprises finite difference analysis.

44. The method as defined in claim 39, wherein said numerical analysis comprises boundary element analysis.

45. The method as defined in claim 23 wherein an axial movement corresponding to said incremental rotation of said bit is determined wherein a sum of axial forces on all of said plurality of cutting elements approximately equals said selected axial force on said bit.

46. A method for optimizing drilling parameters of a roller cone drill bit drilling an earth formation, comprising:

selecting bit design parameters, comprising at least a geometry of a cutting element on said bit;

selecting initial drilling parameters, comprising at least an axial force on said bit;

selecting an earth formation to be represented as drilled;

calculating from said selected drilling parameters, said selected bit design parameters and said earth formation, parameters for a crater formed when one of a plurality of said cutting elements contacts said earth formation;

calculating a bottomhole geometry, wherein said crater is removed from a bottomhole surface;

simulating incrementally rotating said bit, and repeating said calculating of said crater parameters and said bottomhole geometry based on calculated roller cone rotation speed and geometrical location with respect to rotation of said roller cone drill bit about its axis; and adjusting at least one of said initial drilling parameters, and repeating said calculating said crater parameters, said bottom hole geometry and said simulating incrementally rotating until an optimal set of said drilling parameters is obtained.

47. The method as defined in claim 46, wherein said optimal set of drilling parameters is determined when a rate of penetration is maximized.

48. The method as defined in claim 46, wherein said bit design parameters comprise cutting element and roller cone geometry forming part of a computer aided design file comprising design model of said bit.

49. The method as defined in claim 48, wherein said cutting element and roller cone geometry are converted to coordinates prior to entry into said method.

50. The method as defined in claim 46, wherein said bit design parameters comprise at least one of cutting element count, cutting element height, cutting element geometrical shape, cutting element spacing, cutting element location, and cutting element orientation, cone axis offset, cone diameter profile, bit diameter.

51. The method as defined in claim 46, wherein said drilling parameters comprise at least one of axial force on said bit and rotational speed of said bit.

52. The method as defined in claim 46, wherein said calculated crater parameters are derived from laboratory tests comprising a cutting element having selected geometry being impressed on an earth formation sample with a selected force, said tests generating at least a correspondence between penetration depth of said cutting element into said formation and said selected force.

53. The method as defined in claim 52, wherein said selected force comprises an axial component.

54. The method as defined in claim 52, wherein said selected force comprises a lateral component.

55. The method as defined in claim 52, wherein said tests are conducted under selected confining pressure.

56. The method as defined in claim 52, wherein said laboratory tests are interpolated to enable selection of earth formations having properties and bit design parameters having values intermediate of ones used in said laboratory tests.

57. The method as defined in claim 52, wherein craters created in said laboratory tests are converted to coordinates describing a geometry thereof, and said coordinates are selected to define a cross-section, said cross-section forming a principal input for said calculated crater parameters.

58. The method as defined in claim 46, wherein said calculated crater parameters are determined from numerical analysis of penetration of a cutting element having a known geometry impressed on a earth formation having known mechanical properties with a selected force.

59. The method as defined in claim 58, wherein said selected force comprises an axial component.

60. The method as defined in claim 58, wherein said selected force comprises a lateral component.

61. The method as defined in claim 58, wherein said numerical analysis comprises finite element analysis.

62. The method as defined in claim 58, wherein said numerical analysis comprises finite difference analysis.

63. The method as defined in claim 58, wherein said numerical analysis comprises boundary element analysis.

64. The method as defined in claim 46, wherein an axial movement corresponding to said incremental rotation of said bit is determined wherein a sum of axial forces on all of said plurality of cutting elements approximately equals said selected axial force on said bit.

* * * * *